US005182925A

United States Patent [19]

Alvarez et al.

[11] Patent Number: 5,182,925

[45] Date of Patent: Feb. 2, 1993

[54] INTEGRALLY FORMED, MODULAR ICE CUBER HAVING A STAINLESS STEEL EVAPORATOR AND MICROCONTROLLER

[75] Inventors: Robert J. Alvarez, Denver; Scott E. Bredesen, Englewood; James J. Wilson, Westminster; Duane D. Flim, Aurora, all of Colo.; Todd E. Kniffen, Williamsburg, Iowa; Clinton O. Schahrer, Longmont, Colo.

[73] Assignee: Mile High Equipment Company, Denver, Colo.

[21] Appl. No.: 701,440

[22] Filed: May 13, 1991

[51] Int. Cl.[5] ..... F25C 1/12

[52] U.S. Cl. ..... 62/347; 621/515

[58] Field of Search ..... 62/347, 515; 165/171, 165/170

[56] References Cited

U.S. PATENT DOCUMENTS

| | | | |
|---|---|---|---|
| 2,014,703 | 9/1935 | Smith | 62/515 |
| 2,638,754 | 5/1953 | Kleist | 62/515 X |
| 2,992,545 | 7/1961 | Walker | 62/515 X |
| 3,456,452 | 7/1969 | Hilbert | 62/347 X |
| 4,192,151 | 3/1980 | Carpenter | 62/347 X |
| 4,344,298 | 8/1982 | Biemiller | 62/347 |
| 4,590,774 | 5/1986 | Povajnuk | 62/347 |
| 4,823,559 | 4/1989 | Hagen | 62/515 X |
| 4,995,245 | 2/1991 | Chang | 62/515 |

*Primary Examiner*—William E. Tapolcai

*Attorney, Agent, or Firm*—Hubbard, Thurman, Tucker & Harris

[57] ABSTRACT

An ice maker module is built on an integrally formed plastic base. One or more ice making modules are stacked on top of an ice bin. Integrally formed within the plastic base is "wet" compartment within which are disposed multiple numbers of evaporators on which water is frozen into ice cubes. The plastic base also separates the wet compartment from a dry compartment in which is mounted refrigeration components and control circuitry. The evaporators are constructed of two plates of stainless steel. Icing sites are located on the flattened sides of a serpentine refrigeration channel formed between depressions in the stainless steel plates. A microcontroller operates the ice making process. Harvesting of the ice cubes is initiated after the ice maker has used an amount of water necessary to make the ice. An ultrasonic range finder monitors the amount of ice in the bin.

15 Claims, 10 Drawing Sheets

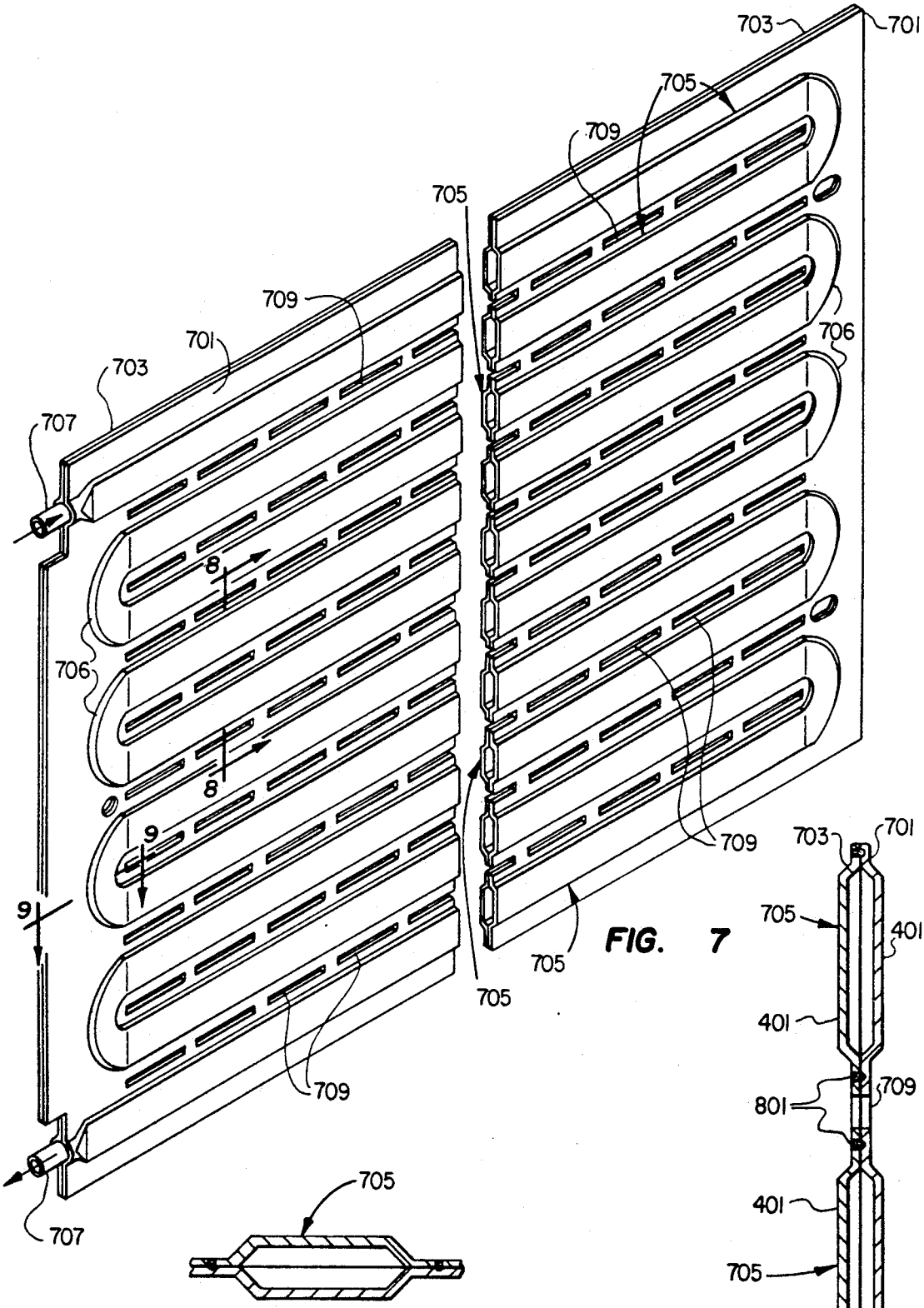
FIG. 7
FIG. 9
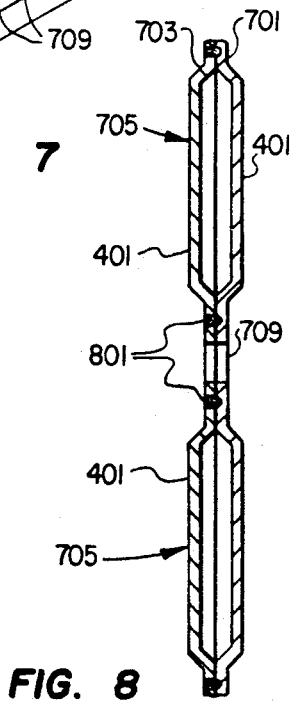
FIG. 8

INTEGRALLY FORMED, MODULAR ICE CUBER HAVING A STAINLESS STEEL EVAPORATOR AND MICROCONTROLLER

FIELD OF THE INVENTION

The invention pertains generally to ice making machines and methods for making ice cubes, and more particularly to self-contained machines for making ice cubes ("ice cubers"), the ice cuber having, among other features, a modular construction, a microprocessor for controlling its operation, and evaporators constructed from two plates of stainless steel that are welded together and have formed therebetween a refrigerant channel. The invention further pertains to methods for manufacturing ice makers and evaporators for ice makers.

BACKGROUND OF THE INVENTION

There are basically two types of ice makers: household units in refrigerators; and self-contained commercial units for use in hotels, restaurants, bars, hospitals and other establishments that require large amounts of ice. Commercial units are further dividable into two types, depending on the type of ice they make: flaked or cubed.

Unlike household ice makers which freeze water in a tray with cool air in a refrigerated compartment, a commercial ice cube maker circulates a steady stream of water over a chilled ice mold to deposit thin layers of ice in the pockets of the mold for building into ice cubes. Water that does not freeze after being circulated over the ice mold is collected in a sump and recirculated over the chilled mold until it cools enough to freeze. After ice cubes are formed, they are harvested from the mold and stored in an unrefrigerated ice bin from which they may be retrieved. The bin remains unrefrigerated so that the ice melts slowly, thereby preventing it from sticking together.

Cold refrigerant from a refrigeration circuit chills the ice mold. In a typical refrigeration circuit, a compressor driven by an electric motor that compresses refrigerant to a high pressure and supplies it to a condenser. The condenser cools the compressed refrigerant with air blown across coils with a fan or with water. The refrigerant is then passed through an expansion valve, the expansion valve dropping the pressure of the refrigerant considerably, thereby cooling it. The cooled refrigerant then flows through copper tubing that has been welded to the back of a copper plate, called the evaporator plate. Welded to the evaporator plate is a lattice-like copper structure that is used to mold the ice into cubes. Together, the lattice-like structure and the evaporator plate form the ice mold. Taken together, the ice mold and the copper tubing are simply referred to as the evaporator.

An electronic controller, sometimes microprocessor-based, operates the fans, motors, pumps and valves that control the functioning of the ice maker.

Commercial ice makers are expected to continuously and reliably produce substantial amounts of ice. They are used in service industries, where a unit breaking down or producing insufficient ice causes disruptions of service. When there is no ice, service suffers and customers are quickly irritated: few people, for example, enjoy warm soft drinks. An unreliable ice maker will quickly erode a firm's goodwill and its business. An unreliable ice maker also costs the manufacturer money and goodwill. When the ice maker is down, its manufacturer must spend money either quickly repairing it or furnishing substitute ice.

A better ice cube is generally not sought, just a less expensive one, ice being a fungible commodity. Therefore, in addition to reliability, holding down the cost of an ice maker by controlling the cost of manufacturing and operation is a paramount concern in the art. Low cost operation requires that ice be made efficiently by conserving electricity and water; and further that the ice maker be nearly maintenance-free, as down-time for maintenance costs money and someone must be paid to do it. Low cost operation and maintenance must extend over many years, as ice makers are expected to have long, productive lives.

Efforts to achieve low cost, efficient, highly reliable operation are beset by a number of problems, most of all by the fact that cost, efficiency and reliability are frequently traded one for the other in designing and manufacturing ice makers. Some, but by no means all, of the common problem areas are: manufacturing a structure for ice making operation; harvesting ice; handling of water; manufacturing the evaporator; and generally controlling the operation of the ice maker, including initiating and terminating freezing and harvesting, purging and detection of ice levels in the ice bin.

Problems associated with harvesting the ice center around the fact that ice cubes freeze to the surfaces of the ice molds. The most common harvesting method is, not surprisingly, to unfreeze them by quickly warming the evaporator and melting the ice immediately adjacent to the surfaces of the mold. To warm the evaporator, the cycle of the refrigeration circuit is essentially reversed by opening a solenoid-operated valve (termed a hot gas solenoid or valve) to permit hot refrigerant from the compressor to flow directly into the evaporator. This method is termed in the art a hot gas defrost.

Despite the unfreezing, the cubes often do not simply fall out of the ice mold. Water from the melting ice creates a "capillary"-like action that tends to suck the cubes into the pockets of the ice mold. Gravity is often used to overcome this capillary-like action. The evaporator is oriented so that the pockets of the ice mold face down, or it is placed vertically and equipped with downwardly slanting pockets. However, even gravity cannot always be relied on to ensure that all the ice cubes are harvested simultaneously for quick harvesting and energy efficiency. Mechanical means are sometimes used in the place of, and sometimes in conjunction with, gravity to nudge or assist the ice. To simplify the mechanical means, water is recirculated over the ice mold until ice bridges are formed between the ice cubes thereby connecting the cubes into a single sheet of ice that can be pushed out of the mold. The bridges are thin and usually break easily after harvesting. Using a mechanical means for dislodging ice, however, increases the cost of manufacturing and makes the ice maker more prone to malfunction. Further, in order to freeze ice bridges between ice cubes, the freezing or icing portion of an ice making cycle must be extended to ensure that sufficiently strong ice bridges are formed between all the cubes in the pockets. Increasing the freezing time reduces ice making capacity and efficiency.

The problems of water are how to keep it from leaking out, and how to reduce its corrosive effects on equipment. Making ice requires a lot of water, and therefore also requires a water tight means of handling it so that it will not spill on the floor, get electrical components wet or corrode the interior of the ice maker. When orienting an evaporator vertically, water to be frozen cascades down the front of the ice mold, causing water to splash and creates a waterfall of unfrozen water at the bottom of the evaporator. The unfrozen water is collected in a reservoir or sump and recirculated over the evaporator. Constructing a structure to deal with this water without leaking usually involves seals having all sorts of clamps, screws, and other types of fasteners to make them water-tight. Consequently, assembly, maintenance and repair are complicated; the number of possible failure modes increases; and costs generally go up. Protecting metal parts against corrosion caused by the water and humidity, or using corrosion-resistant metals in the parts, also costs money and assembly time.

In addition to designing an evaporator that improves harvesting, manufacturing them tends to be expensive. In an evaporator refrigerant passes through a coiled copper tube. Copper is chosen because of its inherent property of good heat transference. The copper tube is welded to an evaporator plate in a coiled fashion. A lattice-like copper structure is then welded to the other side of the evaporator plate for creating the ice mold. Welding ensures good transference of heat. The entire evaporator is constructed of copper, as mating copper against other types of metals generally reduces rates of heat transfer. Constructing the evaporator is, consequently, labor intensive and expensive. Further, only one side of an evaporator can be used to make ice; a second plate cannot be easily welded to the copper tube once the first has been welded.

Finally, the problems of controlling the operational cycle of the ice maker—ice-making and harvesting of the ice particularly—are numerous.

One of the biggest problems is determining when to initiate harvesting. As the refrigeration circuit transfers heat from water that will be made into ice to air (in air cooled systems) or to cooling water (in water cooled systems), the ambient temperature of the air and the temperature of the water supplied to the ice maker directly effects the amount of time that is required to freeze the ice. Customers expect and want an ice maker to function in uncontrolled climates, such as outdoors. An ice maker is thus often subjected to temperature extremes of air and water. Consequently, since the refrigeration capacity of the ice maker is fixed, the amount of time that it takes a particular ice maker to freeze the water into ice cubes and to initiate the harvesting cycle changes considerably during the course of the year when out-of-doors, or possibly when it is moved between locations.

The freezing portion of the ice making cycle should continue, for energy efficiency and to achieve maximum ice making capacity, only as long as is necessary to ensure that, for a given air and water temperature, the proper freezing of the ice and its prompt harvesting. One approach to determining when to begin harvesting is by monitoring the actual ice build-up on the evaporator with a mechanical probe. However, mechanical probes are not always reliable, as they malfunction and must be properly adjusted to function properly and efficiently. They also complicate the ice making apparatus, increasing manufacturing costs and maintenance problems. Many ice makers, therefore, trade efficiency for simplicity and reliability: they use timers to initiate harvesting, the time being set long enough to ensure proper freezing of the ice cubes over a predefined range of ambient air and water temperatures that the ice maker is designed to face.

Similarly, heating of the evaporator should only last as long as is necessary to complete harvesting. Heating melts ice. Where the capacity of the evaporator is low, a significant fraction of the pounds of ice may be melted unless harvest is carefully controlled. The result of an unnecessarily long harvest, in addition to a lot of water, is a warm evaporator that takes longer and more energy to chill and a longer operational cycle that reduces capacity.

A control system of an ice maker, again for reasons of efficiency and reliability, must further decide when to stop making unneeded ice and when to resume making ice. The ice bin must therefore be equipped with a reliable ice level detection system.

SUMMARY OF THE INVENTION

The preferred embodiment of the invention is a new generation of commercial, self-contained ice cube maker having a new overall design and a complement of improved components. The design of each of the components, singularly and collectively, reduce the cost manufacturing, maintenance and operation, and increase reliability of operation of the ice cuber.

The design of the ice maker is modular, having one or more vertically stacked ice making modules on top of a commonly shared ice bin. Each ice making module is a self-contained unit that includes refrigeration circuitry and control circuitry. Each operates independently. Housings for the ice making module are constructed such that one or more of them may be stacked vertically, without the aid of fasteners or special modification, on top of a common ice bin. The capacity of an ice cuber is thus easily increased or decreased, before or after installation. Plugs are provided for connecting in a daisy chain a shared ice bin level sensor so that all ice making modules stop making ice when the ice bin is full.

The construction and manufacture of an ice making module solve a number of problems relating to reliability and cost. The module has an integrally formed, rotocast plastic base. The base has three walls and a bottom integrally formed therein that surround a "wet" compartment and separate it from a "dry" area. It further includes an integrally molded sump for holding water to be recirculated over the evaporators. Within the wet area is an evaporator for forming the ice, over which is set a water pan that distributes water among, and provides a constant, even and smooth flow of water to, the evaporators. In the dry area are mounted the compressor motor, condenser, fan, water pump and control circuitry. The integrally formed base structure eliminates the need for folded, fitted and hemmed edges for metal casework and corrosion protection. Creating a wet area within an integrally formed plastic base significantly reduces the number of joints from which water may leak and eliminates many of fasteners that may be otherwise required. Assembly costs are thus reduced, and keeping the electrical equipment dry increases reliability of operation.

Carrying through on the modular design concept, the wet area accommodates from one to four evaporators placed within slots integrally formed with the base. Each ice making module is easily adaptable to handle this range of ice making capacities. Many of the components designed to support expansion are easily adaptable. Housing fewer components to support a line of ice makers having a range of capacities reduces overall manufacturing costs and improves reliability with better quality control.

Unlike prior evaporators, the evaporators used in the this new ice cuber are constructed from two sheets of stainless steel laser-welded together. Formed within each sheet of stainless steel is a continuous depression that traverses across the sheet, turning 180 degrees at the edges of the sheet, in a "serpentine" pattern. When the two sheets are welded together between the depressions, the edges of the depressions meet and thereby form a serpentine refrigerant channel through which refrigerant passes. Water is directly frozen on the outside of the channel, directly on a "primary" surface. To create cubes of ice and to prevent formation of ice bridges between them, plastic insulators are inserted between adjacent transversing sections of the refrigerant channel and vertical dividers protruding from the surface of the evaporator are added, thereby dividing the surface of the refrigerant channel into an array of icing sites. Water flows down each surface, freezing as it trickles over the icing sites thereby building an ice cube.

The all stainless steel construction of an evaporator makes it corrosion-proof. It is easily manufactured, requiring no coiled copper tubing to carry chilled refrigerant, no evaporator plates welded to the coil, and no copper ice molds. Whereas only one side of prior art evaporators is used to form ice, both sides of the present evaporator are used to form ice, thereby increasing its ice making capacity and efficiency. Shortening the distance between chilled refrigerant and the water to be frozen by forming the ice directly on the refrigerant channel increases the rate of heat transfer between the water and refrigerant, making the evaporator and the ice cuber more energy efficient. Flattening the sides of the refrigerant channel also equalizes the heat transfer rate across the icing site, further improving efficiency.

The construction of the evaporator improves reliability and efficiency in harvesting the ice. The flat surface of the evaporator, without any pockets in which to form the ice cubes, eliminates any need for mechanical means to dislodge the ice. Furthermore, the effect of the capillary-like force in the pockets that develops when warming the evaporator during harvesting is minimized. The force of gravity pulls the ice parallel to the flat surface of the evaporator and down into an ice storage bin.

An electronic controller, which in the preferred embodiment is a programmed microcontroller, controls operation of the ice cuber. The microcontroller is provided inputs from a number of sensors or transducers for monitoring the operations of the ice maker, and turns off and on the electric motors and solenoid actuated valves with its outputs.

To monitor how full the bin holding the ice is, the microcontroller operates an ultrasonic acoustical wave or sonar ranging device that measures the height of the ice in the bin. It permits selection by the user of the amount of ice that will be kept on hand in the bin to suit the user's needs. The ice cube maker stops making ice when there is enough ice in the bin to suit the user's needs. When the ice level drops a predetermined amount in the bin, the compressor is switched on, and the ice maker begins making ice again.

During ice making, the microcontroller determines when the ice should be harvested. To do this, the microcontroller, in essence, tracks the amount of water used by the ice maker. If, presumably, no water has leaked from the wet compartment, the ice is made when the amount of water that has been used equals the amount of water necessary to make a predetermined amount of ice. The microcontroller initiates harvesting at that point. The microcontroller marks the amount of water that has been frozen by, at the beginning of the ice making stage, opening a water-fill valve to fill the sump with water to a "full" level. A self-heating thermistor mounted at the full level acts as a water level sensor, the thermistor dramatically changing resistance when submerged in water. A second, self-heating thermistor, located at "low" level in the sump, is also coupled to the microcontroller for sensing when the sump should be refilled. In the preferred embodiment, the amount of water between the two levels is enough to make ice on one evaporator. When the water level reaches the "low" "refill" level, the microcontroller either: (1) refills the sump to the "full" level if there are additional evaporators, this refilling operation being operated once for each remaining evaporator; or (2) initiates the harvest mode when the number of all operatives equals the number of evaporators.

In the harvest mode, the evaporators are quickly heated by opening a valve to permit hot gas to flow through the refrigeration channels of the evaporators. The hot gas valve is closed as soon as all the ice is likely to be harvested. Generally the temperature of the refrigerant at the output of the evaporators predicts when all the ice has likely been harvested. However, the temperature of the evaporators at the termination of the harvest depends on how hot the gas is at the beginning of the harvest. Consequently, thermistors, coupled to the microcontroller, are located both at the outlet of the condenser and the outlet of the evaporators for sensing temperatures of the refrigerant. The microcontroller determines at the beginning of harvest, based on the temperature of the condenser, a temperature of the evaporators at which it will terminate harvest. Alternately, instead of monitoring the evaporator temperatures for a predetermined temperature, the microcontroller may terminate harvest either: after a predetermined time, based on the condenser temperature at the beginning of harvest, has elapsed; or by detecting a substantial increase in the rate at which the evaporator is warming that indicates ice has fallen off the evaporator. The chances of an incomplete harvest is thereby reduced without unnecessarily extending the heating of the evaporators and melting more ice than is necessary.

The thermistors at the condenser and evaporator are also monitored during other stages of the operational cycle of ice maker. The microcontroller is therefore able to detect a hot gas valve failure by a temperature that exceeds a predetermined maximum level in the evaporator. Similarly, the thermistor at the output of the condenser also permits the microcontroller to prevent damage that may be caused by excessive temperatures in the refrigeration system. A "freeze-up" condition on an evaporator due to an incomplete harvest or a water supply interruption indicated by the fact that the temperature of the refrigerant in the evaporator goes below a predefined minimum temperature during the ice making stage in relation to the condenser temperature, may also be detected.

These and other advantages and novel features of the invention are described with reference to the annexed drawings depicting the preferred embodiment of the invention.

BRIEF DESCRIPTION OF THE DRAWINGS

FIG. 7 is an isometric view of two plates welded together to form an evaporator having a serpentine refrigerant channel.

FIG. 8 is a cross-section, taken along section line 8 of FIG. 7, of a traversal section of a refrigerant channel in the evaporate of FIG. 7.

FIG. 9 is a cross-section, taken along section line 8 of FIG. 7, a bend section of a refrigerant channel in the evaporator of FIG. 7.

DETAILED DESCRIPTION OF THE DRAWINGS

Figure 1:
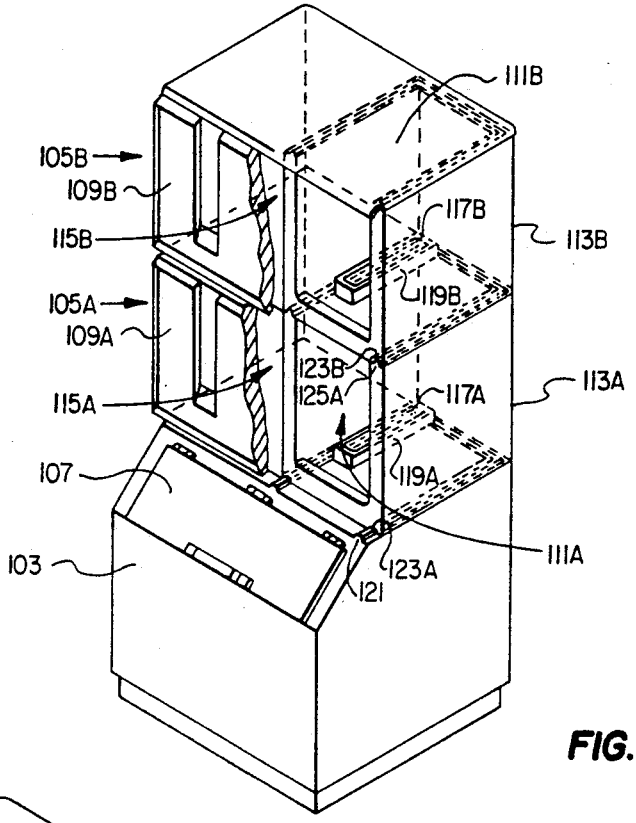
FIG. 1 is an isometric view of the exterior of an ice bin stacked with two ice making modules.

In the following written description of the preferred embodiment shown in the drawings, like reference numbers refer to like elements. Where there is a multiple number of substantially the same element depicted, the elements are identified with the same reference number, but different letters may be appended to the end of the same reference number where it its helpful to the description to identify a particular one of these elements. For example, a description referencing element "10" applies to elements marked by "10A", etc.

Referring now to FIG. 1, ice maker 101 includes an ice bin 103 and two ice making modules 105A and 105B, each substantially identical. Since ice making modules 105A and 105B are substantially identical, generally only one will be described, with reference to it as ice making module 105, though they will be distinguished where necessary.

Ice bin 103 is an insulated, but not refrigerated, compartment for storing ice. Door 107 provides access to ice stored in ice bin 103. Ice bin 103 is not refrigerated to permit the ice to slowly melt and thereby prevent it from sticking together.

An ice making module 105 houses refrigeration components, control circuitry and evaporators (not shown) for freezing water supplied to it into ice cubes. Ice making module 105 is shown with a front cover 109 cut away, displaying a wet compartment 111, in which evaporators (not shown) are place for making ice, and a dry compartment 115, in which is placed electrical equipment and other refrigeration circuitry (not shown). A wall portion of base 113 divides the wet compartment 111 and dry compartment 115 for confining water used to make ice to the wet compartment.

Wet compartment 111 is defined on three sides and the bottom by base 113, with the remaining side covered by front cover 109. Dry compartment 115 is defined on bottom by a shelf portion of base 113, which portion is not shown in FIG. 1, extending laterally from the wet compartment for mounting refrigeration circuitry in dry compartment 115.

Base 113 is, in the preferred embodiment, fabricated from polyethylene material that is foamed in place for strength and dimensional control using rotocast techniques. The resulting base 113 is integrally formed, with double-wall construction sandwiching a layer of insulation; it has no joints through which water can leak; it will not rust; and it has rigidity and strength.

Within each base 113, defined by passage side-walls 119 integrally formed with base 113, is an ice passage 117 through which ice harvested in wet compartment 111 drops into ice bin 103. When multiple ice making modules are stacked as shown, ice passage 117B in ice making module 105B opens into wet area 111A of ice making module 105A. Ice harvested from wet area 111B of ice making module 105B falls through wet area 111A and through ice passage 117A, ice passages 117A and 117B being vertically aligned when ice making module 105B is stacked on ice making module 105A.

For proper alignment of ice bin 103, ice making module 105A and ice making module 105B, raised tracks 121 on top of ice bin 103 mate with groove portions 123B of base 113. No fasteners are required for securing the weight of ice making module 105A and 105B being sufficient to secure them in place. Lid panel 127 closes the top of wet compartment 111B of ice making module 105B. The bottom of base 113B serves as a top to wet compartment 111A.

Figure 1A:
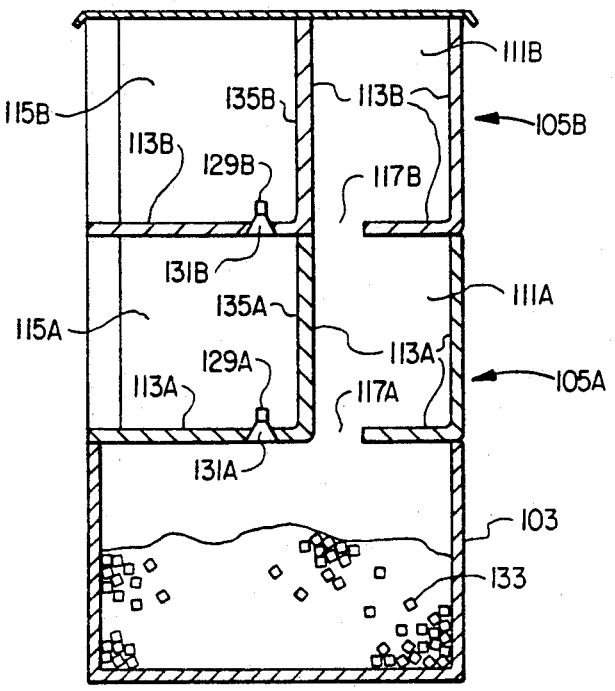
FIG. 1A is a schematic cross-sectional view of an ice bin stacked with two ice making modules.

Referring now to FIG. 1A, a schematic cross-section of an ice maker shows ice making modules 105A and 105B stacked on ice bin 103. The bottom of ice making module 105A serves to enclose the top of ice bin 103. A transducer 129A for an acoustic range finding system using ultrasonic sound waves is mounted to the end of horn opening 131A. 131A. The transducer emits downwardly, through the horn, ultrasonic sound waves into ice bin 103 and receives echoes of the waves reflected from ice 133 or, as the case may be, the bottom of ice bin 103. Though it is not used, ice making module 105B also includes a horn 131B, ice making modules 105A and 105B manufactured from the same mold. Horns 131A and 131B are integrally formed in bases 1313A and 113B. respectively, near as possible to wall sections 135A and 135B, but on the side opposite ice passages 117A and 117B and in dry compartment 115A and 115B.

A suitable range finding transducer 131 is made by Polaroid Corporation of Cambridge, Mass. for its ultrasonic ranging system. The range finding transducer is operated with a controller (not shown) located within each ice making module 105. Though the ranging operation of such a ultrasonic range finder is well known, briefly the controller operates it as follows. The controller issues an initiating signal to the transducer, typically by changing a bit level signal or by sending a pulse on an output line (not shown) connected to the transducer 131, causing it to emit ultrasonic sound pulse. Simultaneously, the controller records the time of the initiating signal and initates a timer 137 that is set to a predetermined time. The transducer, upon reception of an echo of the ultrasonic sound pulse, responds to the controller with a signal ("echo signal") on an input line (not shown). If on the other hand, the timer "times out", the time in which an echo should have been detected has passed, and the controller stops looking for the echo signal. The ranging is repeated with a new initiating signal. With a successful ranging, the controller stores the time difference between the initiating signal and the echo signal, and resets the timer. The controller then conducts several more, preferably up to eight, rangings, and then averages the times. Comparing the average time with an expected time, the expected time being determined in advance and stored by the controller for a given ice level in the bin, the controller is able to determine the level of ice in the bin. With an ice bin level selector 140, a user can select from a number of ice levels for which ranging times have been predetermined and stored in the controller. In the preferred embodiment, the functions of the controller is handled by a microcontroller that also handles all of the control functions of the ice making module. (See FIG. 15) The microcontroller initiates the rangings and uses the results to determine when to stop or to continue, as the case may be, ice making operations.

Ice making module 105B, or any ice making module stacked on top of another ice making module, is usually, for purposes of standardization, equipped with the ultrasonic sound transducer 129B. The controller in ice making module 105B, operatively independently from that of ice making module 105A, will attempt to make rangings with transducer 129B. However, it will not be unable to do so because the top of the dry compartment 115A is so close to the transducer that the echo returns back that can be detected. So that the controller of the top ice making module 105B receives bin level information and does not go into an error mode when unable to carry out rangings, the controllers of both ice making modules 105A and 105B are coupled through a stacking or wiring harness. The wiring harness circuitry enables the controller of an ice making module to determine whether it is the top unit. Further, each of the controllers is provided with bin full in and bin full out lines. The wiring harness couples the bin full out line of the bottom unit to the bin full in line of the upper unit. When the transducer 129 in the bottom unit detects a full bin, the bin full line is turned on and both ice making modules stop making ice after termination of the next harvest.

Figure 2:
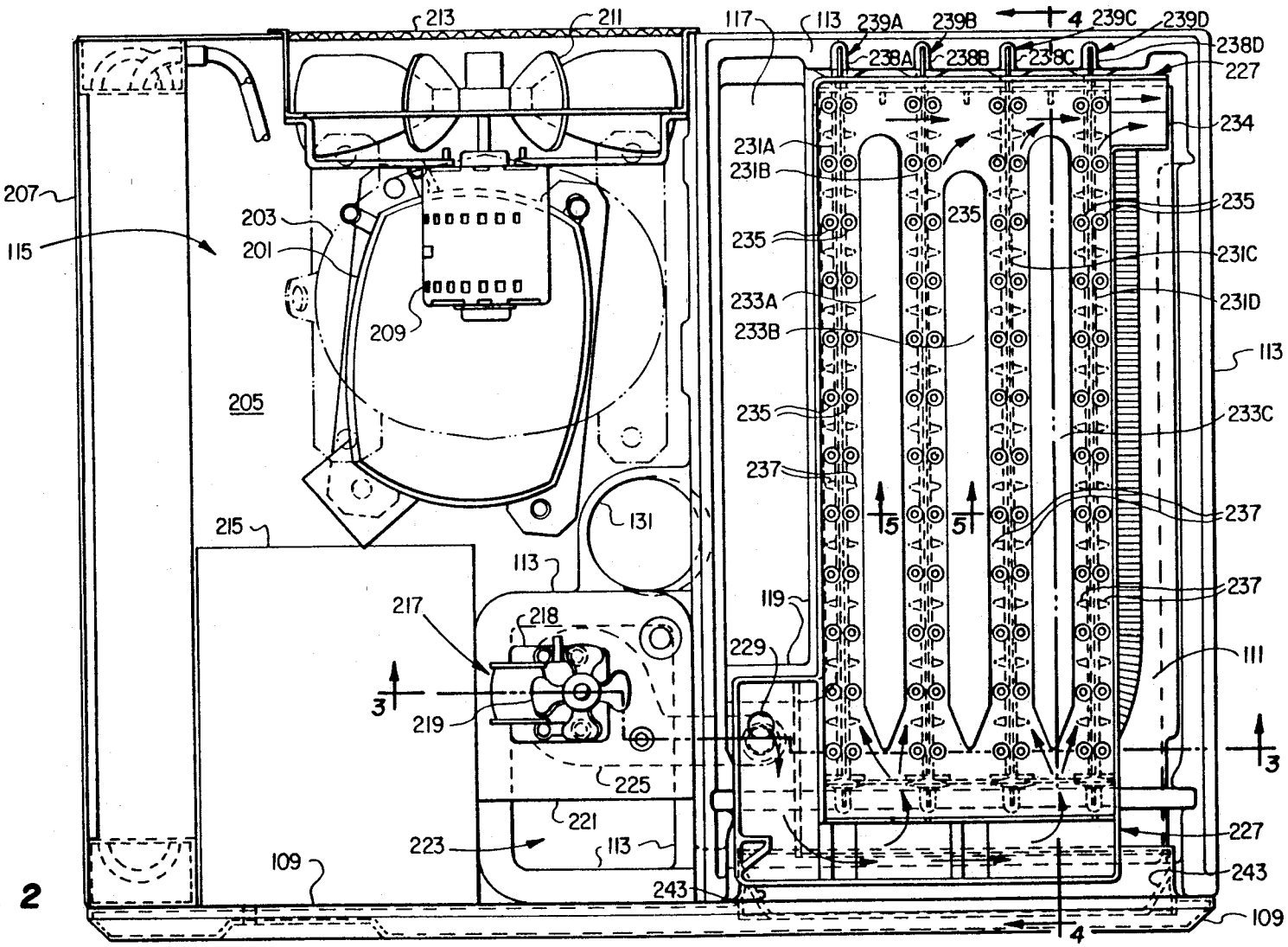
FIG. 2 is a top view of an ice maker module with its top panel removed.

Referring now to FIG. 2, removing lid panel 127 (shown only in FIG. 1) of ice making module 105 reveals wet compartment 111 and dry compartment 115. Within dry compartment 115 is mounted standard, commercially available refrigeration components, compressor 201 and condenser 207. Shown in phantom is an alternate compressor 203. Compressor 203 has a larger capacity and is used with ice making modules 105 having four evaporators. Lower capacity compressor 201 is used with ice making modules having two evaporators. There is no limit inherent to ice making module on the number of evaporators placed in the wet compartment, except for the physical size of the compartment and the space required for refrigeration components large enough to chill the evaporators. Compressor 201 or, as the case may be, compressor 203 is mounted within dry compartment 115 to shelf portion of base 113. Secured to shelf portion of base 113 is a steel plate 205, required by most municipal electrical codes and regulations. Compressed refrigerant from the output of compressor 201, or, if used, compressor 203, is provided through standard tubing (not shown) to condenser 207 for cooling. Cooled refrigerant from the output of condenser 207 then passes to an expansion valve (not shown) which lowers the pressure under which the refrigerant is compressed and thereby chills it. The chilled refrigerant is then provided to evaporators disposed within wet compartment 111. A solenoid actuated hot gas valve (not shown), selectively couples the output of the compressor 201 or 203 to the inputs of the evaporators so that hot, compressed gas may be provided to the evaporators for harvesting ice.

Mounted above compressor 201 or 203 is electric motor 209 that drives fan 211. Rotating fan 211 fan draws in air through filter 213 and pressurizes the interior of ice making module 105. The pressurization forces air through condenser 207 in a uniform manner.

In an upper portion of dry compartment 115 is electrical control box 215, in which is placed circuitry for controlling the operation of the ice making module 105.

Located within dry compartment 115 is a water pump 217. Water pump 217 includes an electric motor 218 coupled to a fan 219 and pump housing 225 (shown in phantom). Water pump 217 is mounted through plate 221 overlaying the top of sump 223, the pump housing 225 extending downwardly from the plate into sump 223. The motor 218 is placed above plate 221. Plate 221 acts as a splash guard against water in sump 223.

Sump 223 is integrally formed within base 113 and serves as a reservoir for holding water to be circulated over evaporators 231A-231D (shown in phantom) and frozen into ice. Sump 223 extends between wet compartment 111 and dry compartment 115, beneath a common wall separating the two compartments, so that it collects water draining from the evaporators in wet compartment 111. The unfrozen but chilled is recirculated by water pump 217 to water pan 227, located in wet compartment 111, through conduit 229.

Water pan 227 delivers water to evaporators 231A-231D at predetermined rates and evenly distributes the water over the length of evaporators 231A-231D. Note that the evaporators are shown in phantom since water pan 227 sets on top of evaporators 231A-231D.

Many of the details of the water pan 227 are discussed in connection with FIG. 6. Briefly, however, water pan 227 includes three raised, island-like sections 233A-233C integrally formed with the water pan. They are located between adjacent evaporators 231A-231D, so as to form, with the edges of the water pan, water troughs that overlay evaporators 231A-231D. The function of raised sections 233A-233C is to reduce the amount of water in the water pan and turbulence in the pan that would interfere with an evenly distributed flow of water down the troughs. The water pan is not as well insulated as sump 223, and therefore it is preferable to keep the water in sump 223 so that it remains cool.

The water pan maintains a depth of water in the tray necessary to ensure even and constant delivery and distribution of the water over a plurality of orifices 235 that are defined in an extend through the bottom of water pan 227. The depth of the water is determined by the height of exit weir 234. The orifices 235 provide water to the evaporators 231A-231D at a predetermined rate. Water delivery orifices 235 are arranged in pairs along the length of the water troughs. One of each pair of water delivery orifices 235 is disposed on either side of an evaporator 231. The pairs of orifices 235 are spaced apart on the length of water troughs such that each orifice 235 is centered between adjacent pairs insulating dividers 237 located on the faces of evaporators 231A-231D.

Evaporators 231A-231D are supported within wet compartment 111 by vertical slots 239A-239D and by support bar 241. The vertical slots are located along the back wall of wet compartment 111 and are integrally formed in base 113. The ends 238A-238D of the evaporators are slid into and secured by vertical slots 239A-239D. Support bar 241 extends across the front of wet compartment 111 and supports the bottom of evaporators 231A-231D. Support bar 241 slides into, and is held up by, slots that are integrally defined in base 113. Secure mounting evaporators 231A-231D requires few or no fasteners.

The front of both the wet compartment 111 and the dry compartment 115 is covered by integrally formed plastic front cover 109. Removal of the front cover provides easy, relatively unobstructed and simultaneous access to all components mounted in the wet and dry compartments for servicing. To facilitate its removal, as well as reduce the number of parts and complexity of manufacture, a minimum number of fasteners are used to secure it to the front of the ice making module. Further, no seals are employed between the wet compartment 111 and the front cover. Instead, lateral flanges 243 projecting inwardly from the front cover 109 into the wet compartment snugly engage a front portion of the inside walls of the wet compartment when the front cover is placed on the ice making module. The fit between the lateral flanges 243 and the inside walls of the wet compartment is sufficiently tight, and the flanges long enough, that water splashing inside the wet compartment is contained and does not leak.

Figure 3B:
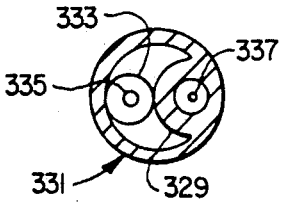
FIGS. 3A and 3B are, respectively, side and top cross-sectional views of a water level detection system for a sump in an ice maker module.
Figure 3A:
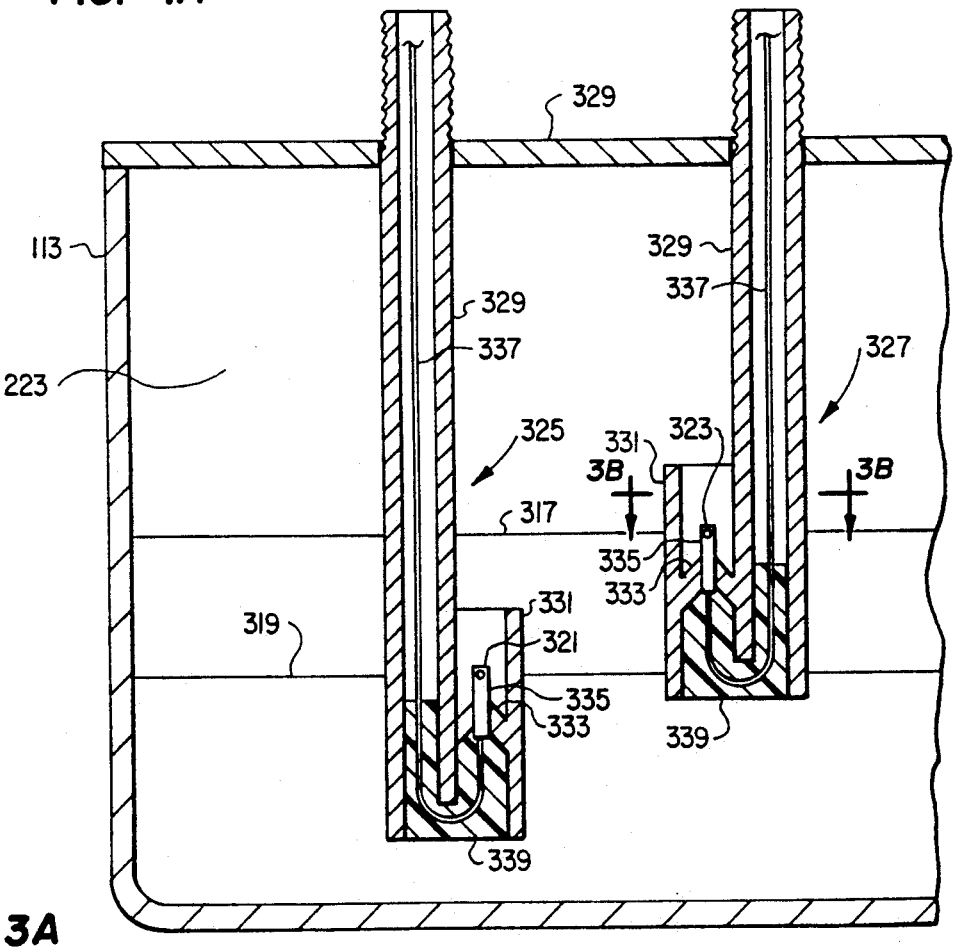
Figure 3:
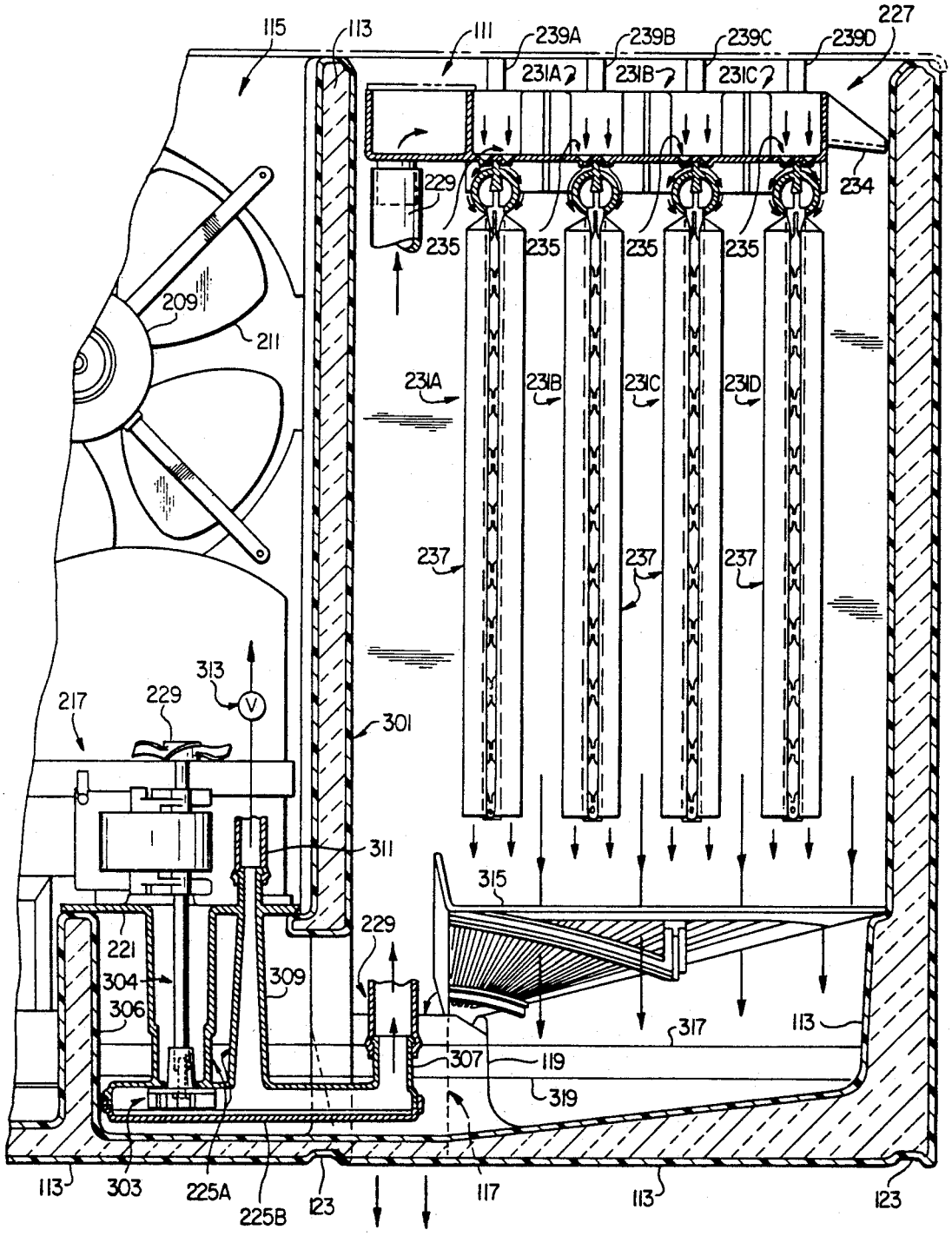
FIG. 3 is a cross-sectional view, taken along section line 3 in FIG. 2, of an ice maker module.

Referring now to FIG. 3, a cut-away, front view of ice module 105 taken along section line 3—3 of FIG. 2 shows the separation of wet compartment 111 and dry compartment 115 by wall section 301 of base 113. Sump 223, defined within the bottom base 113 by integrally formed side-wall sections, extends partially into wet compartment 111 and into dry compartment 115 beneath wall section 301. Sump 223 is as a reservoir for water that will be circulated over evaporators 231A-213D and made into ice. Water remaining unfrozen after being circulated over evaporators 231A-231D drains into sump 223 for recirculation by water pump 217. Excess water in water pan 227 that overflows weir 234 also drains into sump 223. The bottom section of base 113 within wet compartment 111 is sloped downwardly into the sump so that the unfrozen water tends to pool in the sump.

Plate section 221 is integrally formed with the top half 225A of pump housing 225. Motor 218 is mounted on plate 221, with shaft 303 extending through plate 221 for coupling the motor with impeller 303. The edges of plate 221 supports water pump 217 on side-walls 306 surrounding sump 223 and a flange portion of wall section 301.

The bottom half 225B of pump housing 225 includes water openings (not shown) defined in its bottom side. During operation, water inlets of pump housing 225 remains submerged in water in the sump 223 so that the pump remains primed. Impeller 303, driven by motor 218, draws water in sump 223 into the pump housing 225 and pressurizes it. Pump housing discharges the water through sleeve section 307 of pump housing 225 and delivers it to water pan 227 via conduit 229. Conduit 229 is made of flexible tubing that is slipped over discharge sleeve 307. The connection between sleeve 307 and conduit 229 is effectively sealed, and conduit 229 held in place, by an edge projecting outwardly from, and circumscribing, the end of discharge sleeve 307. The edge stretches the flexible tube, the elasticity of the tube creating an opposing sealing force against the edge. As the connection between discharge sleeve 307 and conduit 229 is located within wet compartment 111, any water that may leak from between the discharge sleeve and the conduit tubing is returned to the sump 223.

Pump housing 225 also has a second discharge opening that is located at the end of a tapered sleeve section 309 of pump housing 225. It is coupled to a drain (not shown) through conduit 311 and a solenoid-actuated purge valve 313 (shown symbolically). When not energized, purge valve 313 is closed, preventing discharge of pressurized water through sleeve 309. The purge valve remains closed during ice making or freezing portions of the ice maker cycle.

When water freezes to the evaporators, minerals suspended in the water are not typically trapped in the ice matrix, but are washed away by the unfrozen water. The ice, therefore tends to be pure, but the mineral content of the water is always increasing as water is frozen. Consequently, water is purged during harvesting to avoid mineral build-up in the water. For purging of mineral-laden water from the sump 223, the purge valve 313 is opened by energizing its solenoid. As purge valve 313 and its drain are located at a height below that of water pan 227, pressurized water in pump housing 225 discharges through purge valve 313 to the drain instead of through discharge sleeve 307, purge valve 313 being the path of least resistance. Some water, is, nevertheless, pumped up to the water pan. However, this flows back to the sump and, therefore, most of it is eventually pumped out. Only one valve is thus required for purging.

Like sleeve 307, an outwardly projecting edge circumscribing the opening in the end of sleeve 309 securely holds the conduit 311, made of flexible tubing, on the sleeve. Because sleeve 309 is located over sump 223, any leaked water drains into the sump.

During the ice making or freezing portion of the ice maker's operating cycle, the sump 223 is filled with water to "full" level 317. The "full" level is below the top edge of passage side-walls 119 integrally formed in base 113 around ice passage 117. Low level 319 is above the water inlet openings of pump housing 225 so that water pump 217 remains primed. When the water in the sump falls to "low" level 319, it is refilled to the full level 317 if more water is needed for freezing into ice cubes before harvest of the ice cubes is begun.

In the preferred embodiment, the volume of water between the "low" level and the "full" level is equal to the volume of water required to complete freezing of ice cubes on one evaporator 231. The number of filling operations during an ice making cycle thus equals the number of evaporators 231 disposed within the wet compartment 111. By counting the number of times the sump is refilled, or more particularly the number of times the water falls to the "low" level, the ice making module determines when to initiate harvesting of the ice, harvesting beginning when the water level drops to the "low" level the last time. However, the volume of water between low level 319 and full level 317 can be set to be enough for ice cubes on all the evaporators, thereby completing freezing with only one fill of the sump; or only some fraction of the volume of water necessary to complete icing on one evaporator. Setting the difference between the low and full levels equal to one evaporator's worth of ice permits the sump to serve an odd number of evaporators and further permits the ice making module's controller (not shown, see FIG. 15) to be easily adaptable to any number of evaporators.

However, if accommodation of an undetermined number of controllers is not desired, the most efficient operation would be to make the difference between low and full levels equal to the amount of water to complete ice making on all evaporators running of the sump. Each refill adds warm water that must be chilled. This warm water melts some the ice already formed on the evaporator, that will have to be refrozen. However, since the wet compartment 111 is not cooled, water in the sump will gain heat. Therefore, it may be desirable is some circumstances to keep less water on hand in the sump than is required for complete freezing. The amount of water kept in the sump at which the best energy efficiency must be determined empirically.

Located beneath evaporators 231A–231D, but above "full" level 317, is a molded plastic ice grate 315. During the icing portion of the ice maker's cycle, unfrozen water drips through the ice grate 315 and is collected in sump 223. When the ice is harvested, ice grate 315 catches ice falling from the evaporators and directs it to ice passage 117 for delivery to the ice storage bin 103 (FIG. 1).

Please now refer to FIG. 3A for a description of the method and apparatus for controlling the level of water in the sump 223. Sump 223, shown in symbolic representation, has a low water level 319 and a high water or "full" level 317. A first self-heating thermistor 321 is located at low water level 319 ("low level thermistor"), and a second self-heating thermistor 323 is located at high water or "full" level 317. Both thermistors act as water level sensors.

Thermistors 321 and 323 are temperature sensitive resistors, whose resistances depend on their temperature. Thermistors 321 and 323 are also of a type that is self-heating. In the air, the thermistors tend to remain hot. When submerged in water, however, their self-generating heat is quickly dissipated in the water, the water being a better conductor of heat than the air. Consequently, the resistance of the thermistor suffers a marked change in temperature, and therefore, resistance when being covered and uncovered by water. This wide range swing in resistances is quickly and easily detected by measuring the voltage drop across the thermistors when connected to a constant current source and comparing it to a threshold voltage. The change is so dramatic that any variations induced caused by the insulating effect of mineral deposits, corrosion or age is insignificant. Consequently, self-heating thermistors are preferred as water level sensors or transducers because mineral deposits from the water and corrosion do not effect their operation. However, other types of sensors may be used: thermocouples; mechanical level detectors, such as float switches and valves; and acoustical (ultrasonic) range finders.

Thermistors 321 and 323 are mounted on two probes, 325 and 327, respectively. Each probe is comprised of an integrally formed wire duct 329, splash curtain 331 and cone section 333. The upper end of wire duct 329 may be threaded, if desired, for adjustably securing the probes to mounting plate 330. Mounting plate 330 is supported over sump 223 by portions of base 113 around the edge of the sump and by plate 221 of water pump 217 (not shown, see FIG. 2).

Each thermistor 321 and 323 is sealed in a solid glass capsule 335. The capsule is cylindrically shaped, its diameter being just large enough to accommodate the thermistor. Its length is sufficient to support the thermistor a predetermined distance above cone 333, the thermistor being placed in the upper end of the capsule and the lower end of the capsule extending through a hole defined in the middle of cone 333. From each thermistor 321 and 323 is a twin lead 337 extending down through the glass capsule 335 and the cone, and then around and up through wire duct 329. So that no water finds its way up through the wire duct 329 and the opening in the cone 333, and so that the wire leads 337 do not get wet, the opening at the bottom of the wire duct and the chamber under cone 333 are completely filled after they are installed with sealant 339, preferably a RTV sealant.

Please now refer to FIG. 3B, shown is a cross-section taken along section 3B, of the two probes 325 and 327 of FIG. 3A, each being identical. Water is able to flow up between the splash barrier and around the cone 333 and glass capsule 335. The purpose and function of this arrangement is (1) to prevent water from randomly splashing on a thermistor and (2) to facilitate "shedding" of water by the thermistor while permitting the water level to be quickly and accurately detected by the thermistors. The splash barrier calms the water when it gets to levels where any turbulence may prematurely expose (in the case of low level thermistor 321), or cause water to be splashed on the thermistor and cause erroneous readings. The glass capsule 335 facilitates rapid shedding of water as the water level drops so that the change in temperature of the thermistor is rapid. Glass is used to encapsulate the thermistors because it is a good conductor of heat and it is non-corrosive. Mounting the glass capsule on top of a cone supports the capsule while ensuring that water is quickly shed and not trapped or held around the base of the capsule.

Figure 4:
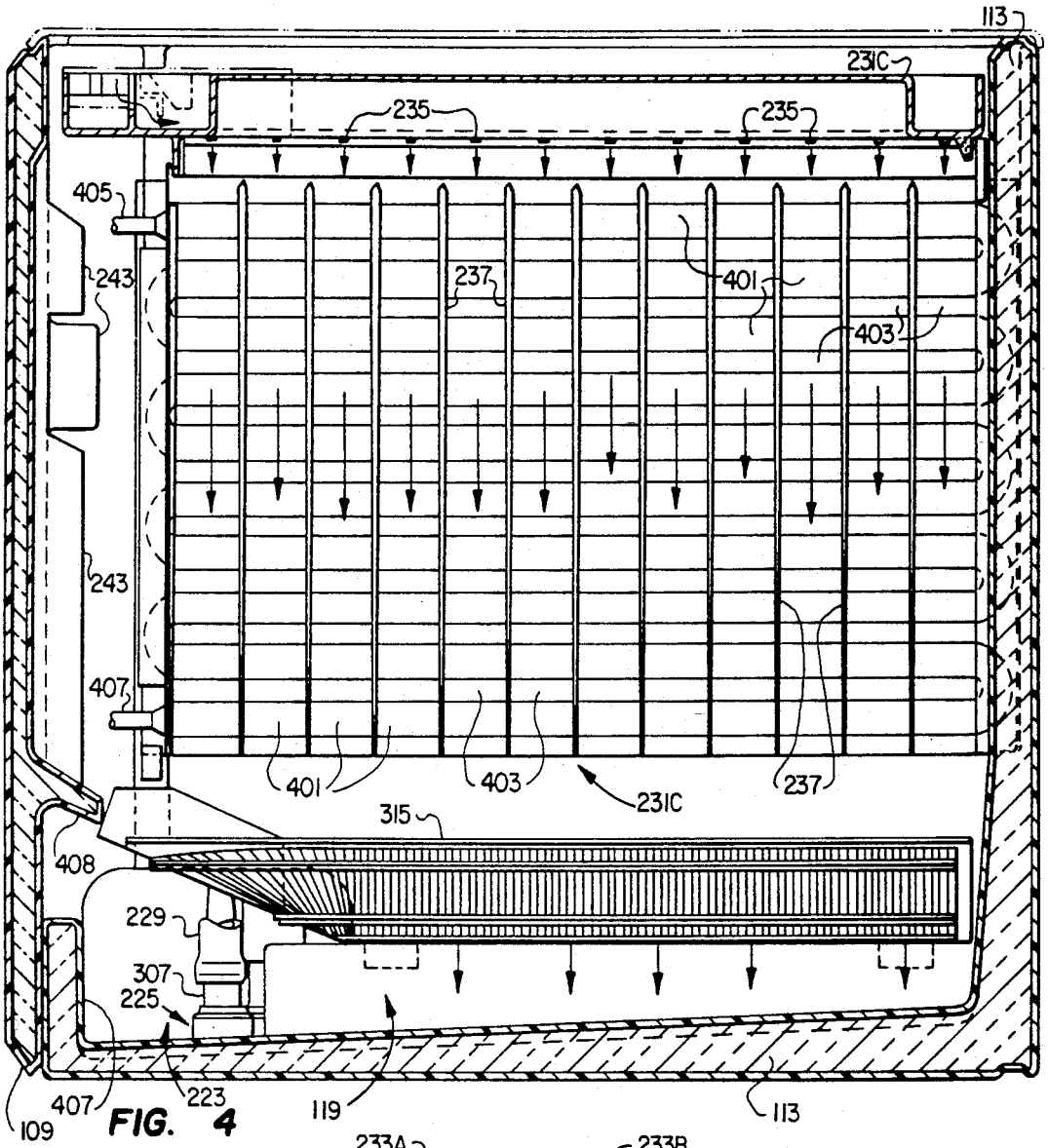
FIG. 4 is a cross-sectional view, taken along section line 4 in FIG. 2, of an ice maker module.

Referring now to FIG. 4, this cross-sectional side view of wet compartment 111 shows one face of evaporator 231C. The faces of evaporator 231C (as well as those of evaporators 231A, 231B and 231D shown in FIG. 3) have an array of flat rectangular freezing or icing sites 401. The icing sites are vertically separated from each other by insulating plastic areas 403. They are horizontally separated by insulating plastic dividers 237 that extend outwardly from the face of the evaporator and have a pyramidal cross-section. The plastic areas 403 are made flush with the surface of the icing sites 401. The plastic dividers 237, as shown in the figure, taper in width from the top of the evaporator to the bottom of the evaporator. By tapering the plastic dividers, the space, or channel, between adjacent pairs of the dividers widens. Widening the channel permits ice cubes to slide down the channel during harvest without jamming or hanging up in the channel.

Water delivered from orifices 235 in the bottom water pan 227 evenly flows down the face of evaporator 231C between insulated plastic dividers 237. To ensure that water is evenly delivered to each icing site 401, one orifice 235 is located midway between each adjacent pair of the insulated plastic dividers.

During an ice-making or freezing cycle, the icing sites 401 are chilled by chilled refrigerant received on line 407 from the output of an expansion valve (not shown). Warmed refrigerant is returned to the compressor on line 405. Plastic areas 403 are not chilled. Water flowing over the freezing sites is thereby chilled with some of the freezing to the site but not to the plastic areas 403. Chilled, but unfrozen water, drains onto the bottom of base 113, and collects in sump 223. The chilled water is then pumped by pump 217 to water pan 227 via conduit 229 and recirculated over the face of the evaporator 231, with some of it freezing, if cold enough, to the surfaces of the icing sites or to ice already formed on the surface of the icing sites. Continuous recirculation of the chilled water eventually deposits layers of ice into "cubes" (though not truly of a cube shape) on the surfaces of the icing sites 401 that will be harvested when they grow to a predetermined weight. A brief side note: the predetermined weight of the ice cube, multiplied by the number of icing sites 401 on the evaporator 231, gives the weight of water that is required for freezing into the ice which, in turn, gives the volume of water between thermistors 321 and 323 in FIG. 3A.

For easy access the wet compartment 111, as well as dry compartment 115 (FIG. 1), front panel 109 is removable. It is secured to the front of ice making module 105 (FIG. 1) with a minimal number of fasteners to reduce the cost of manufacture and improve access time for repair. No seals are used. To prevent leaking, a flange section 408 is integrally molded into front cover 109 for extending over the seam where a front-wall section 407 of base 113 that defines one side of sump 223 meets front cover 109. Lateral flange 243 snugly fits against the inside of side wall 301 of the wet compartment to provide an adequate seal against water splashing into dry compartment 115 (FIG. 1). An opening 409 in the side wall 301 between the wet compartment and the dry compartment is provided for passing copper tubes carrying refrigerant from the refrigeration system, mounted in the dry compartment, to the evaporators mounted in the wet compartment.

Figure 5:
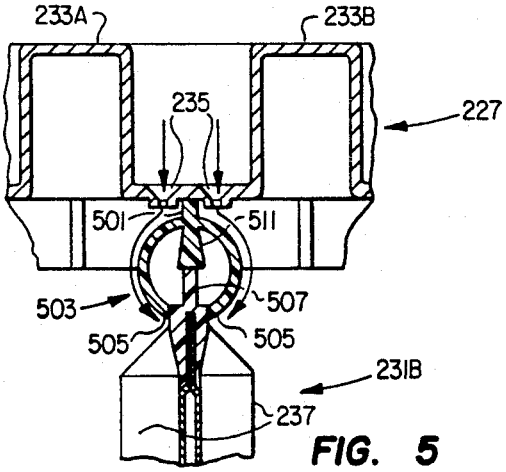
FIG. 5 is cross-sectional view, taken along section line 5 of FIG. 2, of a section of pan for delivering an even flow water to an evaporator for freezing and of a top section of an evaporator.

Referring now to FIG. 5, water pan 227 rests on edge 501 of water distribution cap 503, edge 501 meeting the bottom of water pan between adjacent pairs of orifices 235. Water distribution caps 503 are placed between the top edge of each evaporator 231A–231D and the water pan 227.

Water distribution cap 503 includes two laterally projecting semi-circular members 505, integrally formed with but separated by edge 501, that extend from edge 501 to meet top edge piece 507 of evaporator 231B. Water distribution cap 503 also includes an integrally formed seat 511 which engages and rests on the top edge 507 of the evaporator so that evaporator 231B supports water pan 227. Semi-circular members 505 help to center seat 511 with respect to top edge piece 507.

Each orifice 235 defined in the bottom of water pan 227 receives and collects water from the pan with a conically-shaped, funnel-like flow passage connected to a cylindrically-shaped flow passage for delivering a continuous and even stream of water to a semi-circular member 505 of water distribution cap 503. Surface tension of the water causes it flow around and laterally across the surface of each semi-circular member 505 into a sheet of water having relatively constant depth and a width equal to that of the icing sites 401 (FIG. 4). This sheet of water flows down each face of the evaporator 231B between adjacent dividers 237, and provides an even distribution of water across the entire width of the surface of each icing site on each evaporator.

Figure 6:
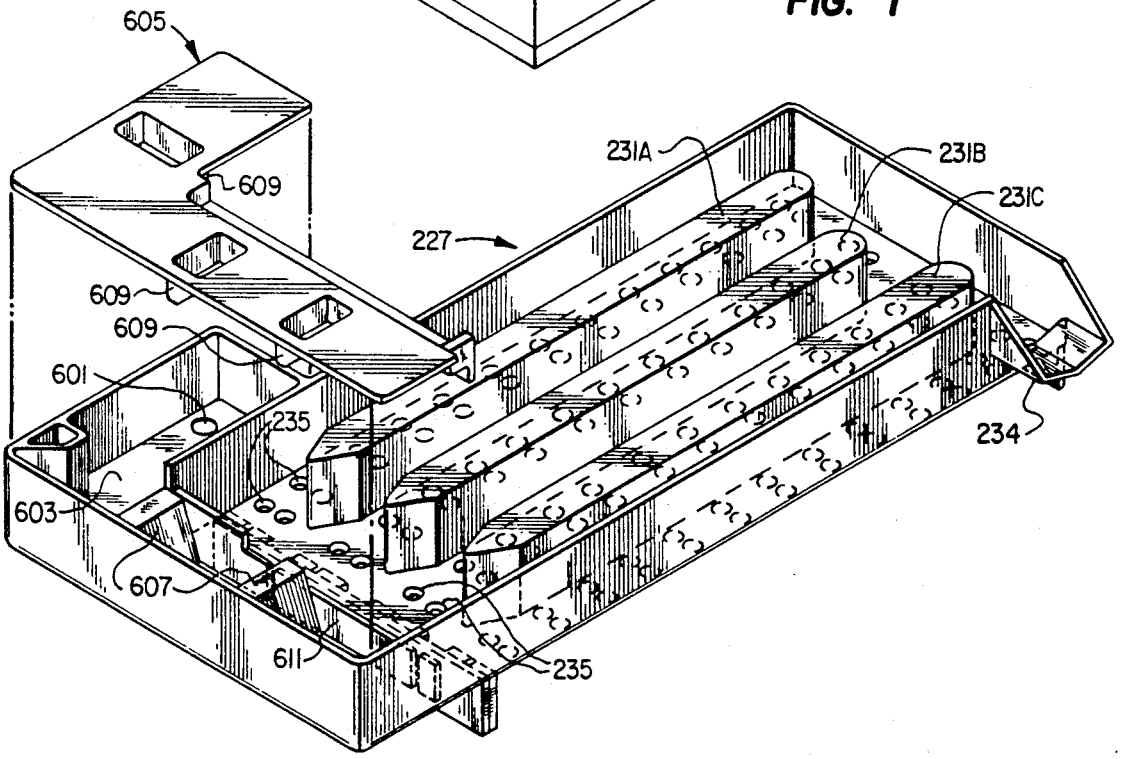
FIG. 6 is an isometric view of a pan for delivering an even flow of water to an evaporator.

Now referring to FIG. 6, water pan 227 is integrally molded from a plastic material. Water pan 227 receives recirculating water from water pump 217 (FIG. 2) through water inlet opening 601. Water pumped through water inlet opening 601 is under pressure and turbulent. To smooth the turbulent water and take some of the energy out of it, water existing in inlet opening 601 is passed through a manifold. Water inlet opening is located at one end of a manifold 603. The function of the manifold is to provide a smooth stream of water evenly distributed laterally across the front of the water pan so that it flows down the troughs between the raised sections 233A–233C and the side walls of the pan and exits over weir 234. Manifold cover 605 is sealed on top of the input manifold 603 so that the manifold is adequately pressurized. A series of weirs 607 integrally formed in the base of the water pan cooperates with a series of downward projections 609 integrally formed in manifold cover 605 to smooth out the water flow through the manifold and prevent eddies from forming. An opening between the manifold cover 605 and a wall 611 integrally formed in the water pan extends laterally across the front of the water pan at a predetermined height. Water pours from the opening, the water being under slight pressure, creating a flat, fountain-like stream evenly distributed laterally across the front of water pan that is relatively free of turbulence. The manifold cover 605 includes an upside-down "L"-shaped projection that extends outwardly from the manifold 603, over the opening to the water pan, and then downwardly to deflect water pouring out of the opening under too high of pressure.

Now referring to FIG. 7, an evaporator 231 (FIG. 2) is assembled from two plates of stainless steel 701 and 703. Each plate is stamped with a continuous, serpentine-shaped (or "S" shaped) depressions. When the plates 701 and 703 meet, the serpentine depressions in each plate extend oppositely from each other. Since the depressions in each plate are mirror images, a continuous serpentine-shaped refrigerant channel is thereby formed and defined by plates 701 and 703. The refrigerant channel is sealed with a laser that welds a continuous hermetic seal along both sides of the refrigerant channel. The refrigerant channel has parallel sections 705 and bend sections 706. The cross-section of the channel in the bend sections 706 thickens and narrows toward the apex of the bend, so that the same cross-sectional area is maintained. By doing so, the bend sections 706 take up less space on the plates 701 and 703 and the flow of refrigerant is not disturbed. At its two ends, the refrigerant channel becomes rounded so that to accept tubing 707 from the refrigeration system for delivery of chilled refrigerant or hot gas, as the case may be, to the interior of the refrigerant channel.

Cut between adjacent parallel section of refrigerant channel 705 are a series of slot openings 709 through which is secured insulating insert 403 (FIG. 4) that separates adjacent parallel sections of the refrigerant channel. Insulating material between adjacent parallel sections retards formation of ice between icing sites 401 (FIG. 4) so that ice bridges do not form between cubes forming on vertically adjacent icing sites. In addition to securing insulating material between adjacent, slots 709 also inhibit formation of ice bridges. Removing portions of the plates 701 and 703 increases the insulating effect of inserts. The inserts are not chilled by refrigerant in the channel 705. And, further, slots 709 permit replacement of the portions with insulating material extending through the plates.

Referring now to FIG. 8, which is a cross-section of a two parallel sections of refrigerant channel 705 along plane 8—8, icing sites 401 are the flat outer surfaces of plates 701 and 703 where they extend outwardly to define refrigerant channel 705. The flatness of the sides of the refrigerant channel 705 helps to assure that the chilling from refrigerant in the channel is uniform across the icing sites 401. Furthermore, the rate of heat transfer is improved by having only one layer of metal between the chilled refrigerant and the water. In the art, freezing water directly on a refrigerant carrying channel is termed freezing on a "primary surface". Located between each section of refrigerant channel and slot opening 709 are continuous hermetic seal welds 801.

Though shown with smooth inside surfaces, heat transfer from the refrigerant in the channel to the icing site or primary surface may be, if desired, increased by texturing the inside surfaces. If texturing is desired, the inside surface of the evaporator plates 701 and 703 are either sand blasted or bead blasted. The inside surface may also be "coined" or "rifled".

Referring now to FIG. 9, a section taken along plane 9—9 of a bend 706 in the refrigerant channel shows that the width of the channel becomes thicker as compared to the width of parallel sections 705 shown in shown in FIG. 8. The outside radius of bend is not the same as that of the inside radius of the parallel and bend sections of the refrigerant channel remaining the same so that no restriction impedes the even flow of the cross-sectional areas of refrigerant through the refrigerant channel. By constructing evaporators with this type of bend section, less area on the face of the evaporators goes unused, providing the opportunity to extend further parallel sections 705 to accommodate more icing sites.

Figure 10:
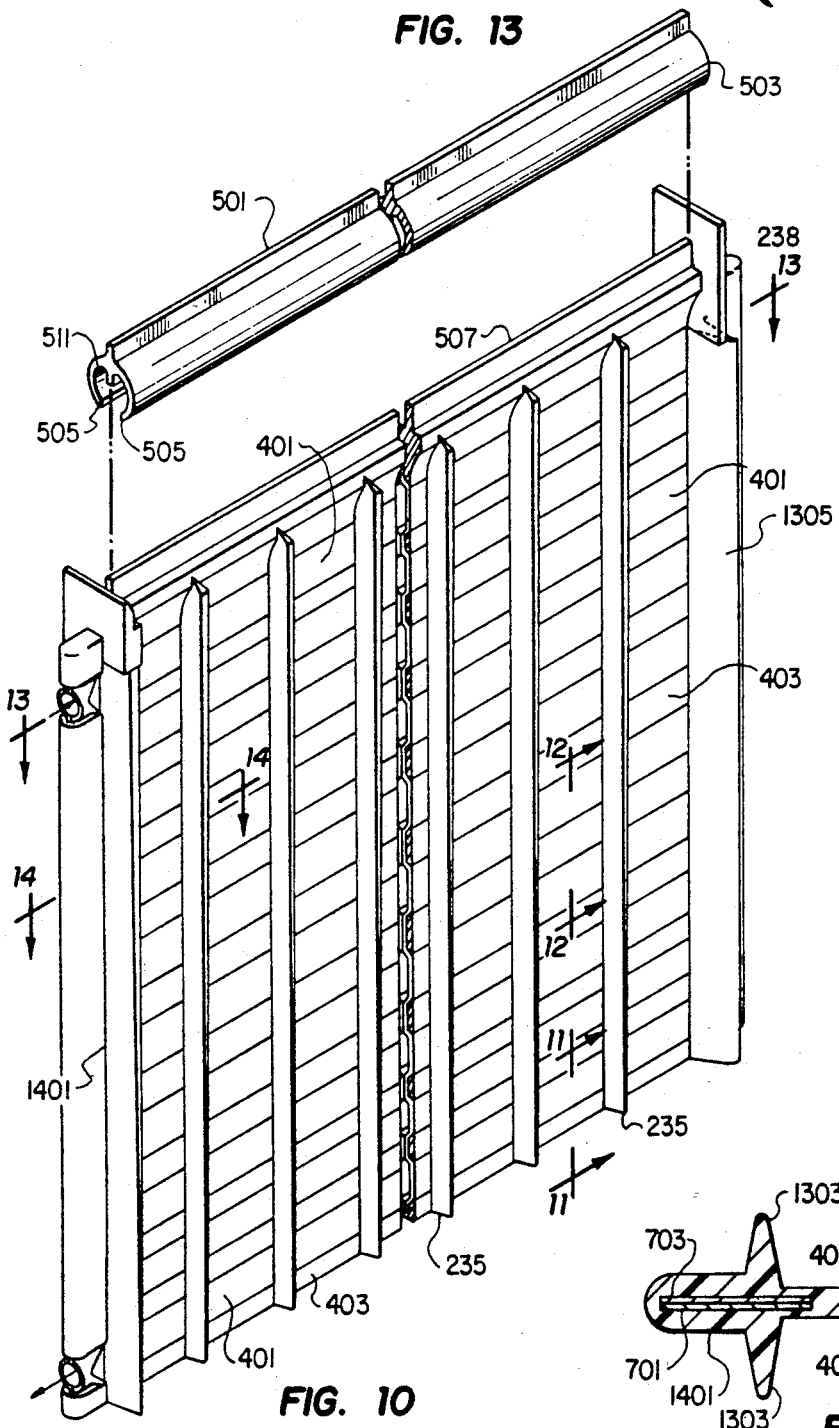
FIG. 10 is a partially exploded isometric view of an evaporator.

Referring now to FIG. 10, after being welded together, the assembled plates 701 and 703 are placed in an injection molding device for molding all plastic pieces directly onto the plate assembly. These pieces include: insulating areas 403, dividers 237, end piece 238, top edge 507, and end piece 1401. Before injection molding, the refrigerant channel in the plate assembly is charged with refrigerant to 200 p.s.i. Because the depression in the plates 701 and 703 forming the refrigerant channels are not rounded, charging is necessary to prevent the collapse or bending of the refrigerant channel by the pressures of the injection molding process. Water distribution cap 503 is fitted to the top edge 507 to form an assembled evaporator 231.

Figure 11:
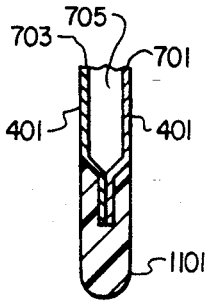
FIG. 11 is a cross-section of the evaporator of FIG. 10 taken along section line 11.

Referring to FIG. 11, a cross-section of evaporator 231 taken along plane 11—11 in FIG. 10 shows how the bottom edge of the evaporator is finished with plastic 1101 molded around the bottom of plates 701 and 703.

Figure 12:
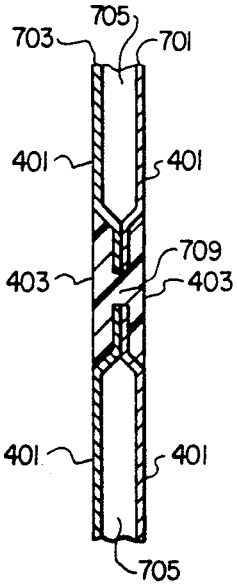
FIG. 12 is a cross-section of the evaporator of FIG. 10 taken along section line 12.

Referring now to FIG. 12, a cross-section of evaporator 231 in FIG. 10 taken along plane 12—12 shows that plastic insulating areas 403 are molded through slot 709 and have surfaces that are flush with icing sites 401.

Figure 13:
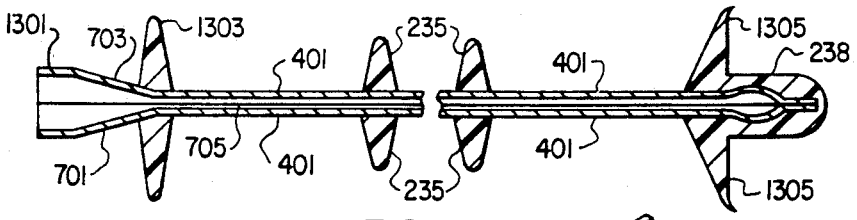
FIG. 13 is a cross-section of the evaporator of FIG. 10 taken along section line 13.

Referring now to FIG. 13, a cross-section taken along plane 13—13 (FIG. 10) of a parallel section 705 of the refrigerant channel, rounded opening 1301 receives tubing coupling the refrigeration channel to compressor 201 (FIG. 2). Plastic, laterally projecting sections 1303 prevent water from flowing or splashing off the front end of evaporator 231 (FIG. 10) next to the front cover 109 of ice making module 105 (See FIG. 2). At the opposite or rear end of the evaporator, plates 701 and 703 are encased by molded plastic end piece 238 for insertion into slot 239 (FIG. 2). Wing-like, laterally projecting sections 1303, integrally formed with plastic end piece 238, create a lip seal with an inside surface of base 113 (FIG. 2) when the evaporator 231 is placed within slot 239 (FIG. 2).

Figure 14:
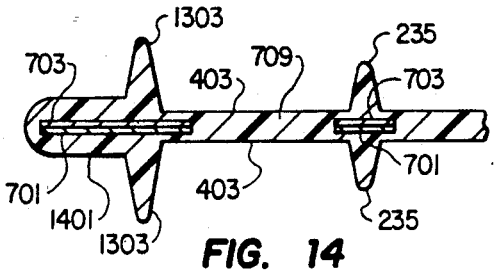
FIG. 14 is a cross-section of the evaporator of FIG. 10 taken along section line 14.

Referring now to FIG. 14, a section of evaporator 231 taken along plane 14—14 (FIG. 10), laterally projecting sections 1303 are integrally formed with end piece 1401. End piece 1401 is molded around the edge of plates 701 and 703. Extending through slot 709 is plastic that forms insulating areas 403.

Figure 15:
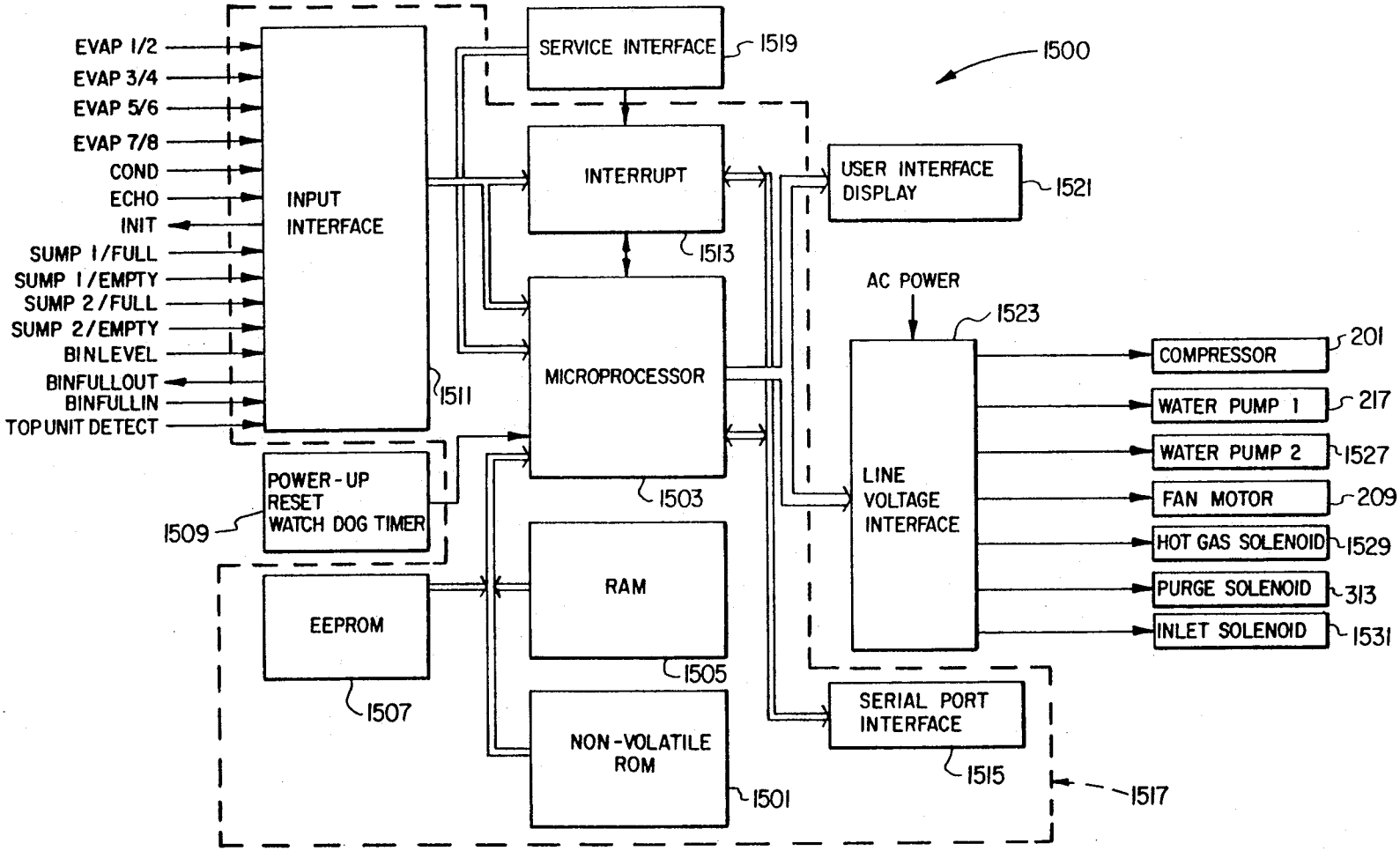
FIG. 15 is functional block schematic diagram of a controller of an ice making module.

Referring to FIG. 15, operation of each ice making module, 105A and 105B (FIG. 1), is directed by its own control circuits mounted within dry compartments 115A and 115B, respectively, in a control box 215 (See FIG. 2). In the preferred embodiment, control circuits are implemented with a microprocessor based controller 1500, though a "hard-wired" analog or digital controller performing similar control functions may be substituted.

Microprocessor 1503 directs controller 1500 to perform predetermined process steps by calling and executing a predetermined sequence of commands, collectively referred to as a program or as software, that are permanently stored in non-volatile, read only memory (ROM) 1501. Also stored in ROM 1501 are any default values for the microprocessor program. Coupled to microprocessor 1503 is Random Access Memory (RAM) 1505 for temporary storage of calculations, data transfers and microprocessor overhead. Electrically Erasable Read Only Memory (EEPROM) 1507 is also included to provide non-volatile, but alterable memory that cannot lost during power failure. Battery-backed RAM may also be used. In EEPROM 1507 is stored parameters, such as the number of cycles since the last purge, that are updated during operation of the ice making module and need to be remembered should the power to the microprocessor be interrupted. A so-called "watch dog timer" circuit 1509 monitors execution by the microprocessor 1503 of a predetermined step that, due to the design of the software, should be regularly executed within a predefined time interval. In the event that microprocessor 1503 fails to execute properly the step, it is assumed that an error has occurred in the microprocessor's execution of the program, and the watch-dog timer resets it.

Microprocessor 1503 collects information from input channels on the state and operation of the ice making module from sensors. Signals sent by sensors on the input channels are first conditioned by input interface 1511. Basically, the input interface provides to the input ports of the microprocessor 1503 signals in a binary digital format having proper voltage and current levels. The input interface 1511 communicates with interrupt circuit 1513, which provides to the microprocessor prioritized "interrupts" for reading input signals from input interface 1511. A serial data communications link can be established through serial port interface 1515 for diagnostic or servicing purposes.

Microprocessor 1503, ROM 1501, RAM 1505, EEPROM 1507, input interface 1511, interrupt circuit 1513 and serial communications interface port 1515, circumscribed by dashed line 1517, are in the preferred embodiment located all on a single "chip" or device termed a "microcontroller". A microcontroller such as one made by Motorola Corporation having the designation or model number of "68HC80588", is suitable. An An input interface 1511 is included in a microcontroller, and therefore the microcontroller carries out some input signal conditioning.

Turning now to the input channels (some of which are used as output channels to send low level data commands), signals from sensors (not shown) may require signal conditioning, level matching, buffering, debouncing, inverting, analog to digital conversion, multiplexing, and electrostatic discharge (ESD) protection before being provided to the microprocessor 1503, depending on the types of sensors being used and the input requirements of the microprocessor 1503. The input interface 1511 in a microcontroller 1517 is not usually able to handle all of these functions. In this event, additional input interface circuitry will be required to precondition the input signal from the sensors or transducers. For convenience, these preconditioning circuits are referred to as transducer circuits, as they combine support functions for the transducer as well as interfacing functions for the output signal. For example, in the disclosed embodiment, most of the sensors or transducers are thermistors. Each thermistor is part of a transducer circuit (not shown) that includes a regulated current source, ESD protection, buffering and level matching to the input interface 1511. Signals from other types of sensors or transducers must be similarly preconditioned if the signals are not suitable for the particular microcontroller chosen.

The input interface 1511 receives signals carrying messages in both analog formats (continuously variable message) or digital formats (discreet message, typically binary). The input interface 1511 of a microcontroller 1517 includes analog to digital converters for converting the analog signals to representative binary data values transmitted on a digital signal to the microprocessor 1503.

When reading an input channel, the microcontroller makes eight readings of the analog signal and averages the data values for the readings. Readings of data on a digital input channel are not, however, technically averaged. Instead they are simply added, and if the sum is greater than four, it reads a digital "1", otherwise zero. Averaging the readings at the input ports increases the accuracy of the readings and reduces the possibility of erroneous readings due to erratic or fluctuating signals from sensors that occur even when the temperature are reasonably settled.

In the preferred embodiment, analog input signal channels to the microcontroller include: four channels from thermistor transducer circuits providing voltage signals that are continuously variable over a predetermined range and that indicate the temperatures of up to eight evaporators, namely "EVAP$\frac{1}{2}$", "EVAP$\frac{3}{4}$", "EVAP5/6" AND "EVAP$\frac{7}{8}$"; one channel, marked "COND", for an analog voltage signal from a thermistor circuit that indicates the temperature of a condenser; and one channel, "BINLEVEL" for an multiple-level voltage signal, generated by a multiposition switch, indicating the desired level of ice in the ice bin level. The EVAP5/6 and EVAP7/7 channels are not used in the four evaporator embodiment herein disclosed, the channels being provided for extending the number of evaporators in the ice making module to eight if so desired. The analog input channels further include two of the four input channels used for sump level detection, namely "SUMP1/FULL" and "SUMP2/FULL". The SUMP2/FULL and SUMP2/EMPTY channels are not used by the ice making module disclosed herein, the channels being provided so that the same controller can be used with a ice making module with two sumps that service up to eight evaporators.

The digital input channels include "SUMP1/EMPTY" and "SUMP2/EMPTY", two channels relating to a bin level detection system and three other channels relating to use of a second ice making module. The transducer circuits for the each of the SUMP/EMPTY channels include compare circuits for comparing the voltage drop across the thermistors to a predetermined threshold voltage midway between the voltage levels across the thermistor when exposed to air and to water. The data on these digital channels is a simple "1" or a "0", or an "on" or "off". The polarity of the thermistor circuits is chosen such that a "1" or "on" indicates true: for example, a "1" from thermistor circuit connected to the low level sump thermistor 321 (FIG. 3A) indicates that the water has dropped below the thermistor.

For the ice bin level detection system using an ultrasonic range finder described in FIG. 1A, one input channel (INIT) is used as a data command channel to the ultrasonic transducer 129 (FIG. 1A) by the microcontroller 1517 to initialize a ranging by the ultrasonic range finder transducer 129 (FIG. 1A); and second input channel is used to receive an echo signal (ECHO) indicating when the transducer heard the echo.

The remaining digital input channels are BINFULL/OUT, BINFULL/IN and TOPUNIT/DETECT. These three channels are connected to a wiring harness, along with the INIT channel. A wiring harness for top unit shorts or connects together the INIT and the TOPUNIT/DETECT channels so that the controller of top ice making module is able to detect that it is the top unit and thereby to know not to continue trying to initialize ranging activity with its transducer 129B (FIG. 1A). The INIT and TOPUNIT/DETECT channels for the bottom ice making module 105A. When the controller of the bottom ice making module 105A detects a "bin full" condition, it turns on the BINFULL/OUT channel. The BINFULL/IN channel for the top ice making module is connected through the harness to the BINFULL/OUT channel of the bottom unit.

A "service" interface 1519 is also provided for controller 1500. The service interface includes switches for turning on and off a the ice making module, for manually initiating purging and washing, and for setting the ice level in the ice bin 103 (FIG. 1). It further includes switches for indicating which evaporators 231A-231D (FIG. 3) have been installed. The service interface may include other controls as needed or desired. A user interface display 1521 indicates with light emitting diodes (LED) the status of the machine: for example, LEDs that indicate that the unit is operating normally and to indicate when it needs "cleaning".

Controller 1500 controls the various physical processes involved with making ice, harvesting, purging and washing through line voltage interface 1523. Line voltage interface 1523 includes a plurality of relay switches (not shown), each coupled one-to-one with a port on microcontroller 1517. Turning "on" a port causes a latching signal to latch the corresponding relay. The relay switches, one for each output device, connect an alternating current (AC) power source on line 1525 from a utility power line to the compressor 201, the water pump 217, optional water pump 1527 (provided for future expansion to a two sump, eight evaporator system), fan motor 209, hot gas valve solenoid 1529, solenoid of purge valve 313 and inlet water valve solenoid 1531. Line voltage interface 1523 also includes current rectifying and voltage transformation circuits for generating from the AC current a 12 volt dc power source for latching the relay switches, and a 5 volt dc power source for the microcontroller and logic circuits.

The program for the microcontroller to carry out the process steps hereinafter described depends on the particular microcontroller. Those skilled in the programming art will be enabled to program the microcontroller from the FIGS. 16–19 and their description which follows. However, for convenience, listing of a suitable program for the microcontroller of the preferred embodiment disclosed herein is provided as an appendix hereto.

Figure 16:
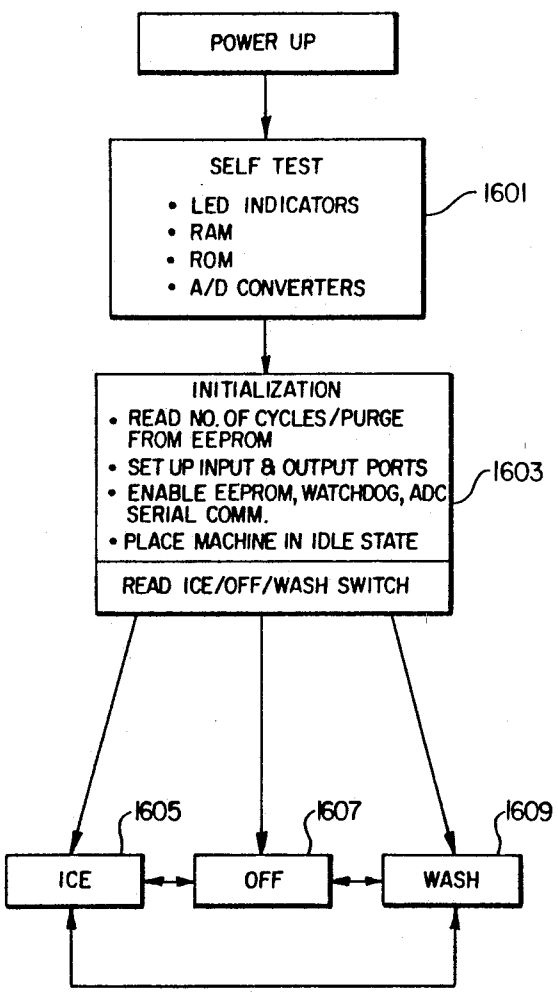

Referring now to FIG. 16, when controller 1500 (FIG. 15) is powered up, it goes through a self-test (block 1601) wherein the LED indicators on user interface display 1521 (FIG. 15) are tested, as are also RAM 1505 (FIG. 15), ROM 1501 (FIG. 15) and analog to digital converters (ADC) that are part of microcontroller 1517. After the self test, the controller initializes itself (Block 1603) with parameters from the EEPROM 1507 (FIG. 15), sets up input and output ports, and enables the EEPROM, watch dog circuit 1509 (FIG. 15) and the ADC's. The machine is then placed in an idle state in which it reads the position of a mode switch on service interface 1519 (FIG. 15). The modes of operation of controller 1500 include an "ice" mode (Block 1605), a "wash" mode (Block 1607) and an "off" mode (Block 1609).

Figure 17:
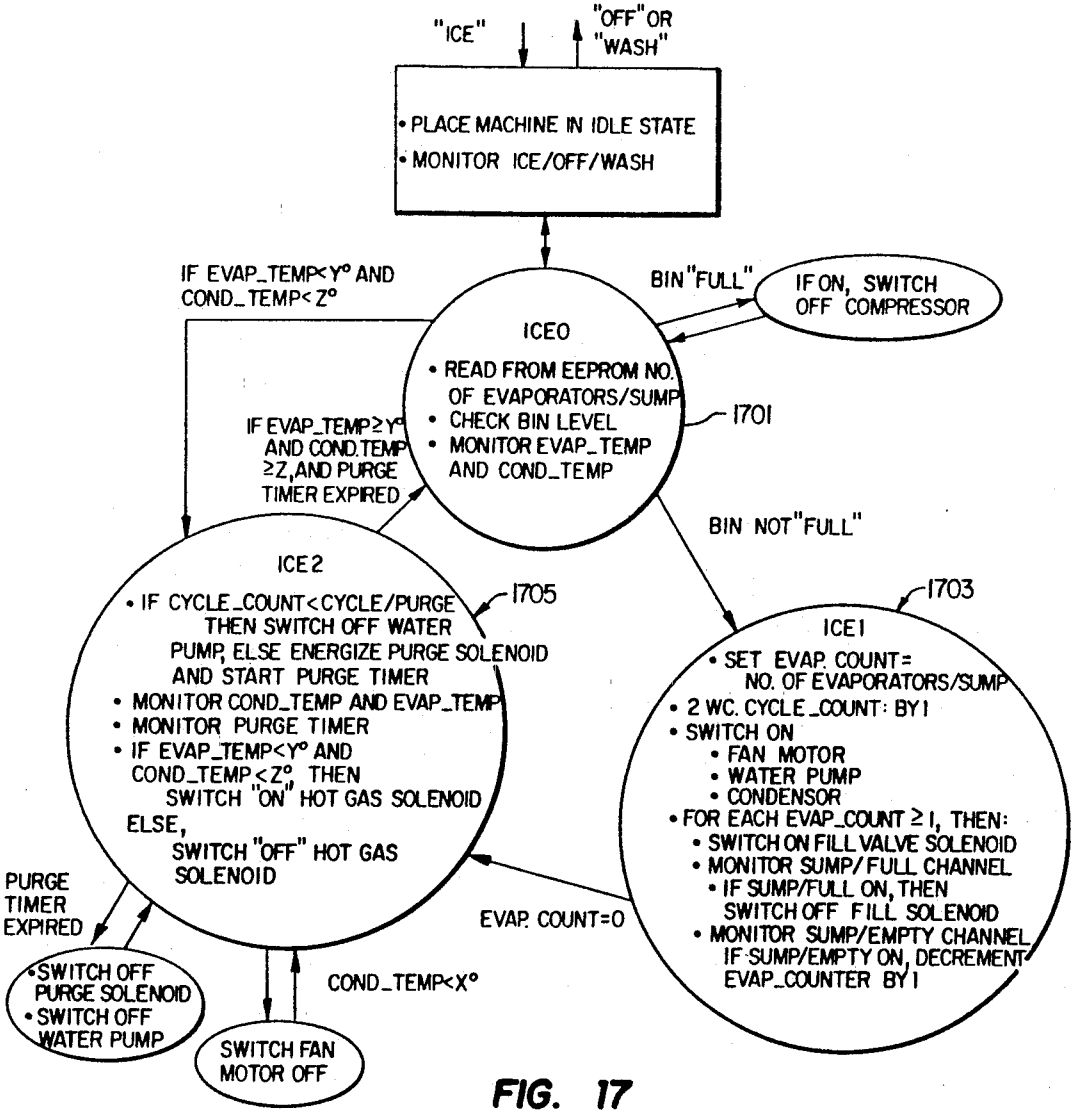
FIGS. 16, 17, 18, and 19 are flow diagrams of control processes for an ice making module.

Referring now to FIG. 17, upon reading the ice mode from the mode switch, the controller proceeds to the first of three ice mode states, ICE0, indicated by Block 1701. While in the ICE0 operational state, the controller first reads from the EEPROM the number of evaporators 231 (See FIG. 2) that have been installed per sump. Then, in essence, it determines whether to begin making ice, moving to the ICE1 state (block 1703) or whether it is to remain in the ICE0 state. The decision is based on whether the ice bin 103 (FIG. 1) is "full". The level of ice in the ice bin is checked by conducting a ranging as described in connection with FIG. 1B. If the ice level in the bin is above the preset bin level (the level being selected by a multiposition switch not shown), the bin is "full" and the ice making module is placed in an idle state with everything turned off.

In the ICE0 state, the controller also monitors the temperatures of the evaporators (EVAP_TEMP) and the condensers (COND_TEMP) by periodically making a reading of the EVAP1/2, EVAP3/4, EVAP5/6, EVAP7/8, and COND input channels. These temperatures are monitored in the ICE0 state in the event that there is unharvested ice on the evaporators. This may occur, for example, when there is an error in the microcontroller or a power interruption that requires resetting of the ice controller. If any of the evaporator temperatures or condenser temperatures are below predefined temperatures when the controller moves into the ICE0 state, the cold temperatures indicating that a harvest was not begun or completed since the last freezing cycle, the controller moves to the ICE2 state indicated by block 1705, an d initiates a harvest.

In the ICE1 state, the controller sets a counter, EVAP_COUNT, equal to the number of evaporators per sump. EVAP_COUNT is initially set to the number of times the sump is to be filled before harvest is initiated. In the preferred embodiment, this is equal to the number of evaporators installed in the ice making module. It also increments by one another counter, CYCLE_COUNT, which tracks the number ice making cycles the ice making module has gone through. CYCLE_COUNT permits the controller to determine when to purge water in the sump to prevent mineral build up and to signal when to wash the machine. Then the controller begins filling the sump with water, opening a fill valve by energizing its solenoid and turning on the water pump 217 (FIG. 2). During the filling operation, the input channel SUMP/FULL which is coupled to a "full" sump level sensor thermistor 323 (FIG. 3A), is exclusively monitored. When the water on the SUMP/FULL input channel is detected, the fill valve is closed. EVAP_COUNT is decremented by one.

The controller, while freezing is taking place, monitors the input channel, SUMP/EMPTY (FIG. 15) from a low level sump sensor, thermistor 321 (FIG. 3A). Once a reading of the SUMP/EMPTY channel indicates that the water level in the sump has fallen to the low level 319 (FIG. 3), the controller has two options. If the EVAP_COUNT is greater than or equal to one, it energizes the solenoid of the fill valve to refill the sump, monitoring exclusively the SUMP/FULL port to determine when the sump is full and allowing the freezing process to continue. The fill valve is closed when the sump is full. EVAP_COUNT is decremented by one. IF EVAP_COUNT is zero, meaning that the freezing of the ice is complete, control passes to the ICE2 state and harvesting is initiated.

Further, throughout ICE1, the controller monitors the temperatures of the refrigerant at the output of the evaporators, EVAP_TEMP, read from input channels EVAP1/2, EVAP3/4, EVAP5/6 and EVAP7/8 (FIG. 15); as well as at the input of the condenser, COND_TEMP, on the COND input channel. If the temperatures are out of range, appropriate corrective action can be taken. When an evaporator goes below a predefined minimum temperature with respect to the temperature of the condenser, it has likely "frozen up" due to an incomplete ice harvest or because the water supply has been lost. The minimum EVAP_TEMP for a given COND_TEMP is given by the following table for the preferred embodiment.

TABLE I

| CONDENSER TEMPERATURE (°F.) | EVAPORATOR TEMPERATURE (°F.) |
|---|---|
| Less than 60 | −2.5 |
| 66–75 | −1.0 |
| 76–80 | 0 |
| 81–85 | 2.0 |
| 86–95 | 4.0 |
| 96–105 | 6.0 |
| 116–115 | 10.0 |

TABLE I-continued

| CONDENSER TEMPERATURE (°F.) | EVAPORATOR TEMPERATURE (°F.) |
|---|---|
| Greater than 115 | 12.0 |

This table is stored in the memory of the controller. When a condenser has a temperature that is too hot for the particular refrigeration system to handle, it must be shut down to protect the refrigeration system from damage.

In the ICE2 or harvest state, indicated by block 1705, water is purged from the sump in addition to the harvest. The sump may need to be purged after every freezing cycle, depending on the mineral content of the water, to make pure or mineral-free ice. Typically, purging every third freezing cycle is sufficient to assure reasonably clean ice. If the CYCLE_COUNT equals the number of cycles per purge read from the EEPROM 1507 (FIG. 15), the controller simply opens the purge valve and continues to run the water pump. A purge timer is simultaneously started, the timer set to amount of time expected for purging the sump. Otherwise, if there is no purge, the water pump is turned off.

A hot gas valve is opened, allowing hot refrigerant gas to flow directly through the refrigerant channels 705 (FIG. 7) of the evaporators. To ensure adequate heat for the harvest, the fan is turned off for a predetermined amount of time before opening the hot gas valve. Generally, if the temperature of the condenser is above 80° F., the fan does not need to be turned off. Otherwise, if it is between 65° and 80° F., it is turned off for 15 seconds; and if it is below 65° F., for 30 seconds. At the beginning of the harvest, the temperature of the condenser is checked. The initial temperature of the gas refrigerant coming out of the condenser is a good predictor of the temperature of the refrigerant at the outputs of the evaporators at which harvest should be terminated, all the ice haven likely fallen off the evaporators. Throughout the harvest, therefore, the evaporator temperatures are monitored, and once the temperatures of the evaporators achieve that temperature, harvest is terminated by closing the hot gas valve. This relationship can be expressed by, EVAP_TEMP<Y° and COND_TEMP<Z°, where Y° and Z° are chosen from the following table:

TABLE II

| CONDENSERS TEMPERATURE (Z° F.) AT BEGINNING OF HARVEST | EVAPORATOR TEMPERATURE (Y° F.) AT TERMINATION OF HARVEST |
|---|---|
| less than 60 | 50 |
| 60-70 | 55 |
| 71 | 56 |
| 72 | 57 |
| 73 | 57 |
| 74 | 58 |
| 75 | 59 |
| 76 | 60 |
| 77 | 61 |
| 78 | 62 |
| 79 | 62 |
| 80 | 63 |
| 81 | 64 |
| 82 | 65 |
| 83 | 65 |
| 84 | 66 |
| 85 | 67 |
| 86 | 68 |
| 87 | 69 |
| 88 | 70 |
| 89 | 70 |

TABLE II-continued

| CONDENSERS TEMPERATURE (Z° F.) AT BEGINNING OF HARVEST | EVAPORATOR TEMPERATURE (Y° F.) AT TERMINATION OF HARVEST |
|---|---|
| 90 | 71 |
| 91 | 72 |
| 92 | 73 |
| 93 | 73 |
| 94 | 74 |
| 95 | 75 |
| 96 | 76 |
| 97 | 77 |
| 98 | 78 |
| 99 | 78 |
| 100 | 79 |
| Greater than 100 | 80 |

This table is stored in the memory of the microcontroller.

There are two alternate methods deciding when to terminate the harvest. In the first, the condenser temperature is checked at the beginning of the harvest and an amount of time likely required for a complete harvest is then looked up in a stored table of condenser temperatures and times. Harvest is terminated after the time has elapsed. These times are determined empirically. In the second, the temperature of the condenser is not checked. Instead, the temperature of the output of the evaporators is closely monitored in order to detect a reasonably sharp change in the rate at which the evaporators are warming. When this sharp change occurs, the ice has fallen off the evaporator and harvest may therefore be terminated.

Once it is initiated, the purge timer is also monitored. When it expires, the purge valve is closed and the water pump turned off. When the predefined temperature relationship EVAP_TEMP≧Y° and COND_TEMP≧Z° has been achieved and the purge timer is not running, the controller passes back to the ICE0 state.

Figure 18:
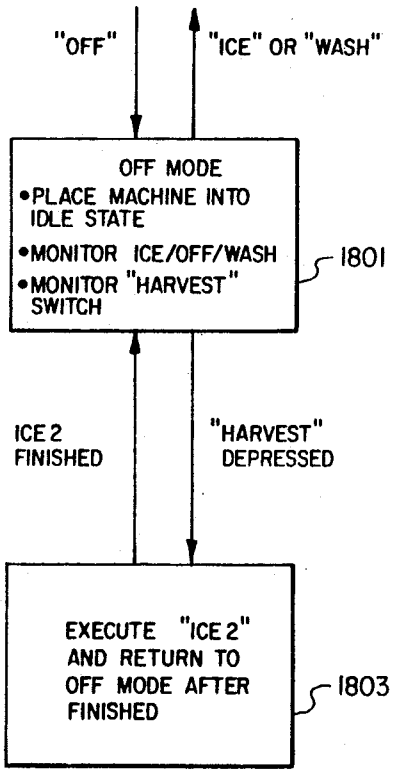

Referring now to FIG. 18, in the "OFF" mode, indicated by block 1801, the controller 1500 (FIG. 15) places the ice making module in an idle state, with all the output devices "off". Always monitoring the ICE/OFF/WASH switch, the controller takes the ice making module back to the appropriate mode if switched to ICE or WASH. Otherwise, at block 1803, it monitors a "HARVEST" switch that, when depressed, takes the controller to the ICE2 state described by block 1705 (FIG. 17) for carrying out a "manual" harvest. This feature clears the ice machine of a freeze up condition. The conclusion of processes carried out in the ICE2, the controller returns to the idle state described by block 1801, turning off all output devices.

Figure 19:
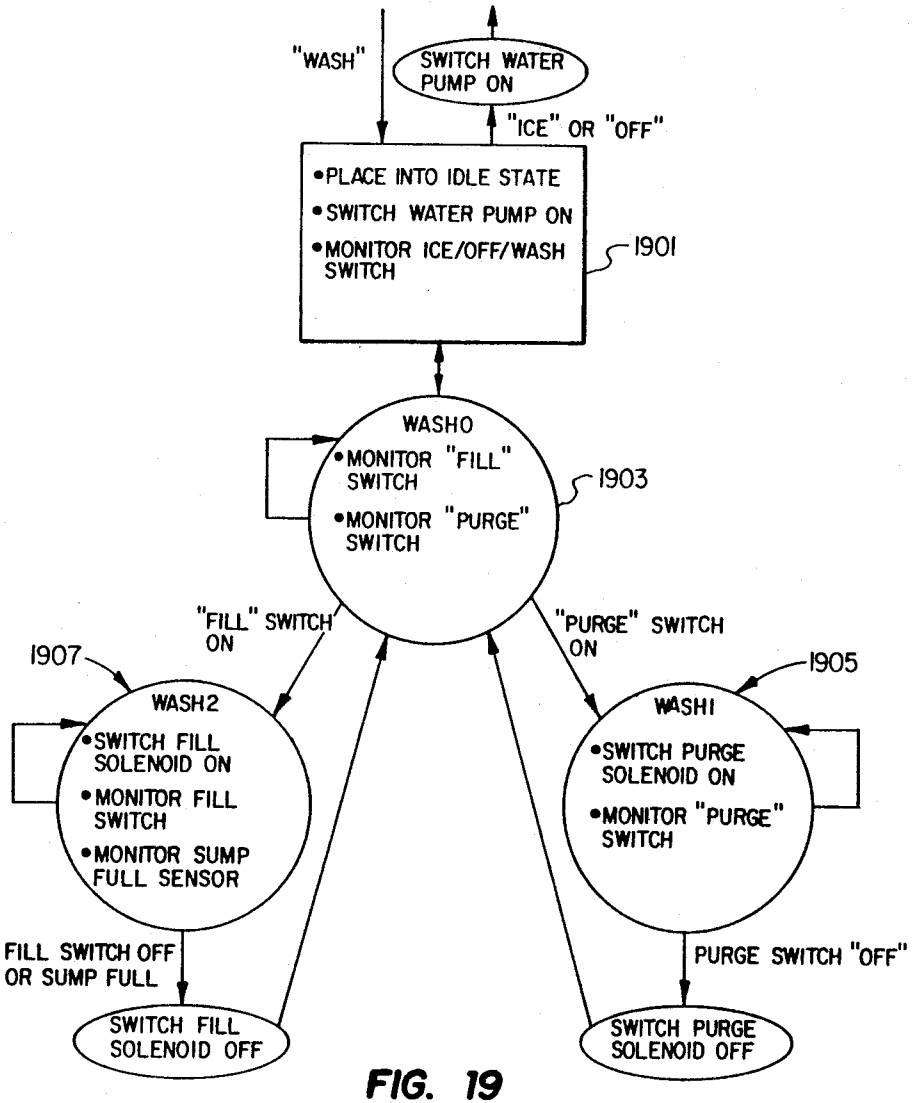

Referring now to FIG. 19, upon being switched with the ICE/OFF/WASH switch to WASH mode, the controller, as described in block 1901 turns off all output devices except the water pump 217 (FIG. 2), and proceeds to the WASH0 state, indicated by block 1903. While in the WASH0 state, the controller monitors manual "FILL" and "PURGE" membrane switches. Pushing on the "PURGE" switch begins a manual purge operation and moves the controller to the WASH1 state, block 1905, wherein the solenoid of purge valve 313 (FIG. 3) is turned on, permitting the water pump to pump out to a drain all the water in the sump 223 (FIG. 2). Turning of the PURGE switch returns the controller to the WASH0 state. Pushing the "FILL" switch on during the WASH0 state causes the controller to move to the WASH2 state, as indicated by block 1907, to open the water fill valve (not shown) and being filling the sump. Monitoring both the FILL switch and the SUMP/FULL input port, the controller closes the fill valve when the FILL switch is turned off or the SUMP/FULL input indicates that it is full, the controller then moving back to WASH0.

The preceding description of the preferred embodiment of the invention is only for purposes of illustrating and explaining the invention. The spirit and scope of the invention is not limited to this embodiment. Instead, it is limited solely by the appended claims and extends to and includes all embodiments encompassed by the appended claims, and equivalent modifications thereto.

What is claimed is:

1. An evaporator for freezing water into ice cubes, the evaporator being chilled by cold refrigerant from a refrigeration system, the evaporator comprising:

a first plate;

a second plate mated with the first plate, the second plate having a stamped sepentine depression, displaced oppositely from the first plate, with traversing spaced-apart parallel sections connected by bend sections so as to form a continuous channel for carrying chilled refrigerant defined between the first plate and the depression of the second plate;

an array of icing sites on which water is frozen, each icing site disposed on an outside surface portion of the parallel sections of the depression of the second plate, over the refrigerant channel to allow for efficient transfer of heat from water flowing across the icing sites to chilled refrigerant in the channel; and means for impeding formation of ice bridges including inserts of material with relatively less of a heat transfer rate than the icing sites located on the outside surface of the second plate between the parallel sections of the depression, the insulating material spacing apart vertically adjacent icing sites in the array of icing sites.

2. The evaporator as set forth in claim 1 wherein portions of the outside surfaces of the parallel sections of the depression of the second plate, on which the icing sites are located, are substantially flat so as to equalize heat exchange rates across each icing site.

3. The evaporator of claim 1 wherein the means for impeding formation of ice bridges between adjacent freezing sites includes laterally extending slots defined in the second plate between adjacent parallel sections of the depression, and further includes matching slots defined in the first plate so as to form a plurality of laterally extending openings inhibiting formation of ice bridges.

4. The evaporator of claim 1 wherein portions of the outside surfaces of the parallel sections of the depression of the second plate, on which the icing sites are located, are substantially flat so as to equalize heat exchange rates across each icing site; and wherein the material with relatively less heat transfer rate than the icing sites, inserted between the parallel sections of the depression in the first plate, has a substantially flat outside surface that is substantially flush with the surface of the icing sites so that the second plate as a continuous flat outside surface over which water smoothly flows.

5. The evaporator according to claim 1 wherein the means for impeding formation of ice bridges further comprises means extending outwardly from second plate for separating horizontally adjacent icing sites in the array of icing sites.

6. The evaporator of claim 5 wherein the means for separating horizontally adjacent icing sites is made of an insulating material to which ice tends not to freeze.

7. The evaporator according to claim 1 wherein the first plate includes a depression, displaced oppositely from the second plate, matching the depression of the second plate when the first and second plate are mated, the refrigerant channel being formed between the depressions in each plate, thereby permitting icing sites to be located on the outside surface of the first plate.

8. The evaporator of claim 7 wherein the first and the second plate have defined through them, between adjacent parallel sections of the depression, matching laterally extending slots for forming laterally extending openings, the openings tending to inhibit formation of bridges of ice between adjacent icing sites.

9. The evaporator of claim 8 further including material having a relatively less of a heat transfer rate than the icing sites, the material being inserted on the outside surfaces of the first and second plates between the parallel sections of the depressions and extending through the laterally extending openings defined in the mated first and second plates.

10. The evaporator according to claim 7 wherein outside surfaces of the depressions of the first and the second plates are flat where the icing sites are located.

11. The evaporator according to claim 1 wherein the first and the second plates are made of stainless steel.

12. The evaporator according to claim 1 wherein the depression at a bend section, in order decrease the area required on the second plate to turn the channel carrying the refrigerant, has a width that narrows from the parallel section to the bend's apex, the serpentine depression at each bend section further having a depth that increases from where it meets the parallel to the bend's apex so as to maintain a cross-sectional area in the channel equal to that in the parallel sections that does not impede refrigerant flow in the channel.

13. An evaporator for freezing water into ice cubes, the evaporator being chilled by cold refrigerant from a refrigeration system, the evaporator comprising:

a first plate;

a second plate mated with the first plate, the second plate having a serpentine depression, displaced oppositely from the first plate, with traversing spaced-apart parallel sections connected by bend sections so as to form a continuous channel for carrying chilled refringent defined between the first plate and the depression of the second plate;

an array of icing sites on which water is frozen, each icing site disposed on an outside surface portion of the parallel sections of the depression of the second plate, over the refrigerant channel to allow for efficient transfer of heat from water flowing across the icing sites to chilled refrigerant in the channel; and means for impeding formation of ice bridges between adjacent freezing sites, the means for impeding formation of ice bridges including laterally extending slots defined in the second plate between adjacent parallel sections of the depression and matching slots defined in the first plate so as to form a plurality of laterally extending openings through the evaporator inhibiting formation of ice bridges.

14. An evaporator for freezing water into ice cubes, the evaporator being chilled by cold refrigerant from a refrigeration system, the evaporator comprising:

a first plate having a serpentine depression with traversing spaced-apart parallel sections connected by bend sections;

a second plate mated with the first plate, the second plate having a serpentine depression, displaced oppositely from and matching the depression of the first plate to form a continuous refrigerant channel between the first plate and the second plate;

a first array of icing sites on which water is frozen, the icing sites disposed on an outside surface portion of the parallel sections of the depression of the first plate over the refrigerant channel to allow for efficient transfer of heat from water flowing across the icing sites to chilled refrigerant in the channel;

a second array of icing sites on which water is frozen disposed on an outside surface portion of the parallel sections of the depression of the first plate over the refrigerant channel to allow for efficient transfer of heat from water flowing across the icing sites to chilled refrigerant in the channel; and matching laterally extending slots defined through the mated first and second plates between parallel sections of the channel, the slots tending to inhibit formation of ice bridges between adjacent icing sites.

15. The evaporator of claim 14 further including an insert of material having a relatively less heat transfer rate than the icing sites located on the outside surfaces of the first and the second plates between the parallel sections of the channel and extending through the laterally extending slots.

* * * * *